US008636012B2

(12) United States Patent
Le Roux et al.

(10) Patent No.: US 8,636,012 B2
(45) Date of Patent: Jan. 28, 2014

(54) SMOKING ARTICLE AND METHOD OF MANUFACTURING A SMOKING ARTICLE

(75) Inventors: Gerhard Le Roux, Stellenbosch (ZA); Karl Kaljura, London (GB); Mark Austin, London (GB); Gary Fallon, London (GB); John Richardson, London (GB); Kevin Blick, London (GB); Mike Simpson, Shibuya-ku (HK)

(73) Assignees: British American Tobacco (Investments) Limited, London (GB); British American Tobacco Japan, Ltd., Tokyo (JP); Tobacco Research and Development Institute (Proprietary) Limited, Stellenbosch (ZA)

( * ) Notice: Subject to any disclaimer, the term of this patent is extended or adjusted under 35 U.S.C. 154(b) by 0 days.

(21) Appl. No.: 13/637,980

(22) PCT Filed: Mar. 14, 2011

(86) PCT No.: PCT/GB2011/050499

§ 371 (c)(1),
(2), (4) Date: Apr. 18, 2013

(87) PCT Pub. No.: WO2011/121327

PCT Pub. Date: Oct. 6, 2011

(65) Prior Publication Data

US 2013/0199551 A1 Aug. 8, 2013

(30) Foreign Application Priority Data

Mar. 29, 2010 (JP) ..... 2010-074233
Feb. 25, 2011 (GB) ..... 1103275.2

(51) Int. Cl.
*A24B 1/04* (2006.01)

(52) U.S. Cl.
USPC ..... 131/361; 131/29; 131/33; 131/58; 131/94; 131/347

(58) Field of Classification Search
USPC ..... 131/361, 29, 33, 58, 94, 347
See application file for complete search history.

(56) References Cited

U.S. PATENT DOCUMENTS 1,518,843 A 12/1924 Evans
2,339,705 A 1/1944 Klingel (Continued)

FOREIGN PATENT DOCUMENTS

DE 43881 C 10/1887
DE 301484 C 5/1916

(Continued)

OTHER PUBLICATIONS

International Search Report and Written Opinion, mailed Jul. 15, 2011, for PCT International Application No. PCT/GB2011/050499, filed Mar. 14, 2011.

(Continued)

*Primary Examiner* — Richard Crispino
*Assistant Examiner* — Dionne Walls Mayes
(74) *Attorney, Agent, or Firm* — N W Poulsen; L A Piñol

(57) ABSTRACT

A smoking article (10) comprising a first part (13) configured to be movable relative to a second part (11) of the smoking article. The first part (13) having a first engaging surface (31). The second part (11) having a second engaging surface (32), the second engaging surface engagable with the first engaging surface (31) to limit relative longitudinal movement between the first and second parts. The first engaging surface (31) and/or second engaging surface (32) is preferably formed on a folded over portion of sheet material.

68 Claims, 8 Drawing Sheets

(56) References Cited

U.S. PATENT DOCUMENTS

| | | | | |
|---|---|---|---|---|
| 2,493,436 | A | 1/1950 | Atkins | |
| 2,494,776 | A | 1/1950 | Moss et al. | |
| 2,820,462 | A | 1/1958 | Fleischer | |
| 4,601,298 | A | 7/1986 | Nichols et al. | |
| 4,649,944 | A * | 3/1987 | Houck et al. | 131/336 |
| 4,687,008 | A | 8/1987 | Houck, Jr. et al. | |
| 4,716,912 | A | 1/1988 | Leonard | |
| 4,898,190 | A | 2/1990 | Deal | |
| 5,203,356 | A | 4/1993 | Yun | |
| 2008/0276946 | A1 * | 11/2008 | Desmond | 131/187 |

FOREIGN PATENT DOCUMENTS

| | | | |
|---|---|---|---|
| DE | 29916020 | U1 | 12/1999 |
| EP | 0664089 | A1 | 7/1995 |
| EP | 0671131 | A1 | 9/1995 |
| EP | 2033531 | A1 | 3/2009 |
| FR | 1547656 | | 11/1968 |

OTHER PUBLICATIONS

Written Opinion, mailed Jul. 11, 2012, for PCT International Application No. PCT/GB2011/050499, filed Mar. 14, 2011.

International Preliminary Report on Patentability, mailed Sep. 27, 2012, for PCT International Application No. PCT/GB2011/050499, filed Mar. 14, 2011.

* cited by examiner

SMOKING ARTICLE AND METHOD OF MANUFACTURING A SMOKING ARTICLE

CLAIM FOR PRIORITY

This application is a National Stage Entry entitled to and hereby claims priority under 35 U.S.C. §§365 and 371 to corresponding PCT Application No. PCT/GB2011/050499, filed Mar. 14, 2011, which in turn claims priority to JP Application No. 2010-074233, filed Mar. 29, 2010 as well as to GB1103275.2, filed Feb. 25, 2011. The entire contents of the aforementioned applications are herein expressly incorporated by reference.

DESCRIPTION

The present invention relates to a smoking article. In particular, the invention relates to a smoking article having a first part which is moveable relative to a second part. The smoking article may be extendable.

An extendable cigarette is known from U.S. Pat. No. 2,820,462. The cigarette is telescopic, with a tobacco rod slidable within a tube having a filter at the mouthpiece end. The tobacco rod can be slid within the tube to vary the size of an internal chamber.

The present invention provides, in a first aspect, a smoking article comprising: a first part configured to be movable relative to a second part of the smoking article, the first part having a first engaging surface, the second part having a second engaging surface, the second engaging surface engagable with the first engaging surface to limit relative longitudinal movement between the first and second parts.

Thus, longitudinal movement of the first part relative to the second part is restricted.

The present invention provides, in a second aspect, a method of manufacturing a smoking article comprising a first part and a second part, the method comprising: providing the first part of the smoking article having a first engaging surface; providing the second part of the smoking article having a second engaging surface; wherein the first engaging surface is configured to engage with the second engaging surface to limit relative longitudinal movement between the first and second parts.

The present invention provides, in a third aspect, an apparatus configured to produce smoking articles or parts of smoking articles according to the method as claimed.

The present invention will now be described, by way of example only, with reference to the accompanying drawings, in which.

Figure 1:
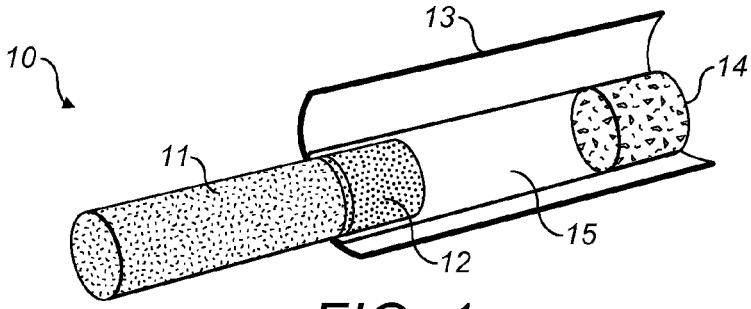
FIG. 1 is a perspective view of a first embodiment of the smoking article.
Figure 2:
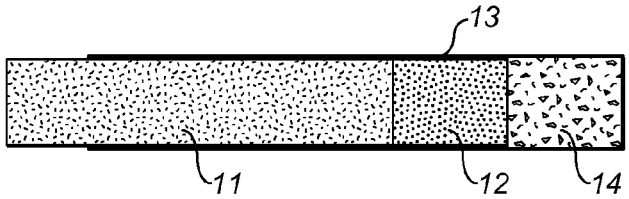
FIG. 2 is a cut-away side elevation view of the smoking article of FIG. 1 in a retracted state.
Figure 3:
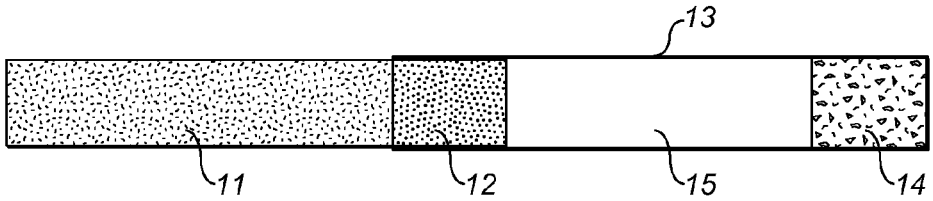
FIG. 3 is a cut-away side elevation view of the smoking article of FIG. 1 in an extended state.

FIGS. 1 to 3 show a first embodiment of an extendable smoking article 10. The smoking article may be an article such as a cigarette, cigar or cigarillo. For convenience, these will be referred to as "smoking articles" in this specification.

The extendable smoking article 10 comprises a tobacco rod 11 with an attached first filter section 12. The tobacco rod 11 and first filter section 12 are attached with a covering layer of sheet material, e.g. paper, and preferably tipping paper.

A first part comprising a sleeve 13 in the form of a cylindrical tube extends around the circumference of the tobacco rod 11 and/or first filter section 12. The tobacco rod 11 and first filter section 12, are dimensioned to slide as a unit longitudinally within the sleeve 13. The tobacco rod 11 and first filter section 12 may be referred to as a tobacco unit, or as the second part of the smoking article.

The first part may further comprise a second filter section 14 at a mouthpiece end of the sleeve 13, distal from the first filter section 12. The second filter section 14 is securely attached within the sleeve 13. The first and/or second filter sections 12, 14 are preferably made of a conventional cellulose acetate tow.

A chamber 15 is defined in the sleeve 13 between the first filter section 12 and second filter section 14. The chamber 15 has a variable length, and hence volume, as the first filter section 12 slides axially within the cylindrical sleeve 13. The chamber 15 has a length varying from zero to a predetermined maximum length. Relative movement of the first and second parts, i.e. sleeve 13 and tobacco rod 11 beyond the maximum length is prevented by a restraining means, preferably abutting surfaces on or adjacent to the tobacco rod 11 and sleeve 13, as will be described later.

FIG. 2 shows the smoking article 10 in a retracted state, with the tobacco rod 11 and first filter section 12 moved up to the second filter section 13. The length of the chamber 15 has been reduced to zero. The smoking article 10 is at its shortest overall length. The smoking article 10 may be packaged in the retracted state prior to use. The smoking article 10 may be returned to the retracted state after use, once the tobacco rod 11 has been partially or fully combusted.

FIG. 3 shows the smoking article 10 in an extended state, with the tobacco rod 11 and first filter section 12 moved as far as possible away from the second filter section 14. The length of the chamber 15 has been increased to its maximum. The smoking article 10 is at its longest length. The smoking article 10 may be in the extended state during use. The tobacco rod 11 and first filter section 12 are continuously positionable within the sleeve 13 to be in any partially extended position between the retracted and extended states.

The tobacco rod and attached filter are described as connected by tipping paper. The tipping paper may be standard tipping paper, or a relatively thick recessed tipping paper, or a board type tipping paper. Alternatively, a tube formed of any material may attach the filter material to the source of smokable material. In particular, such a tube may be made of a plastics material, for example, a plastic made from corn starch. Alternatively, the tube may be made from a ceramic material. Alternatively, the tube may be formed from foil, metal or metallised paper.

Figure 4:
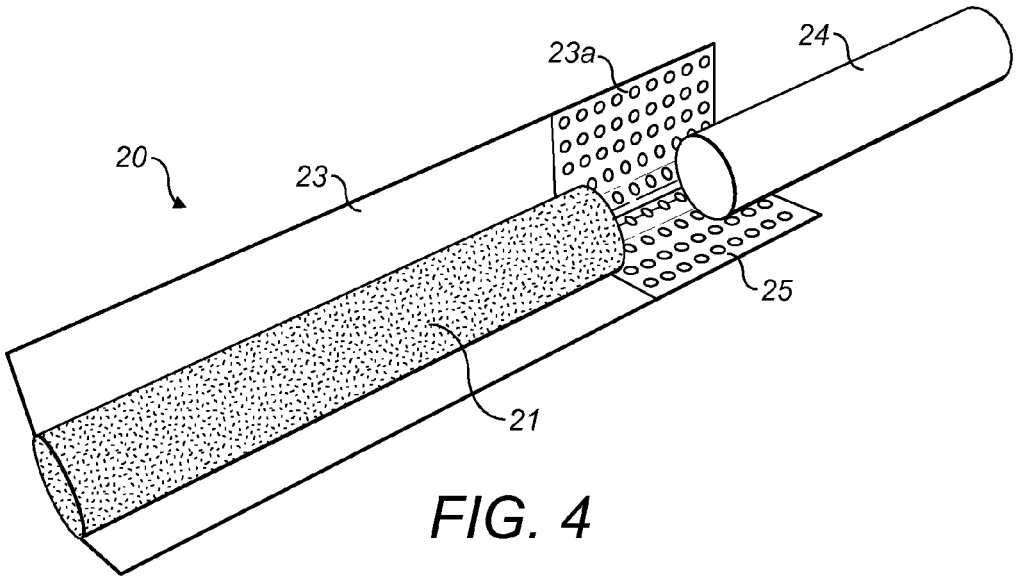
FIG. 4 is a perspective view of a second embodiment of the smoking article

FIG. 4 shows a second embodiment of the smoking article 20. The smoking article 20 comprises a cylinder of tobacco 21 surrounded by, and attached to, a sleeve 23 to form a tobacco rod. The cylinder of tobacco 21 does not move relative to the sleeve 23. The sleeve 23 has a section 23*a* extending rearwardly of the tobacco 21. A filter 24 is longitudinally slidable within the sleeve section 23*a*. A chamber 25 is formed by the tubular section 23*a*, between the tobacco 21 and the filter 24.

The smoking article 20 functions in a similar manner to smoking article 10. Smoking article 20 differs in that the sleeve forming the chamber 25 is rigidly attached to the tobacco rod, not the mouthpiece filter 24. Smoking article 20 also differs by not having a filter attached directly to the tobacco 21. A further embodiment of the present invention may have only one of these features or differences.

The embodiments above have been described as having a filter section at the mouthpiece end of the sleeve. Alternatively, the sleeve may not contain a filter section. In this case, the sleeve defines the chamber between the tobacco unit and the mouthpiece end of the sleeve. Alternatively, the second filter section may be replaced by a stain binder. The smoking article may not have a first filter section. The embodiments described above may have at least one filter section, attached to one or both of the source of smokable material and the mouthpiece end of the sleeve. Alternatively, the smoking article may not include any filter section. FIGS. 5 to 11 show the construction and method of manufacture of a smoking article. The smoking article comprises a restraining means to prevent separation of a first and second part of a smoking article. Preferably, the first part is the sleeve 13 and the second part is the tobacco unit 11. Alternatively, the first part is the sleeve and the second part is a filter. The restraining means limits relative longitudinal movement between the first and second parts (sleeve and source of smokable material). The restraining means allows relative rotation between the sleeve and source of smokable material. The restraining means maintains the sleeve 13 attached to the tobacco unit 11. The restraining means comprises a first engaging surface 31 attached to the sleeve, which is engagable with a second engaging surface 32 attached to the source of smokable material.

Figure 5:
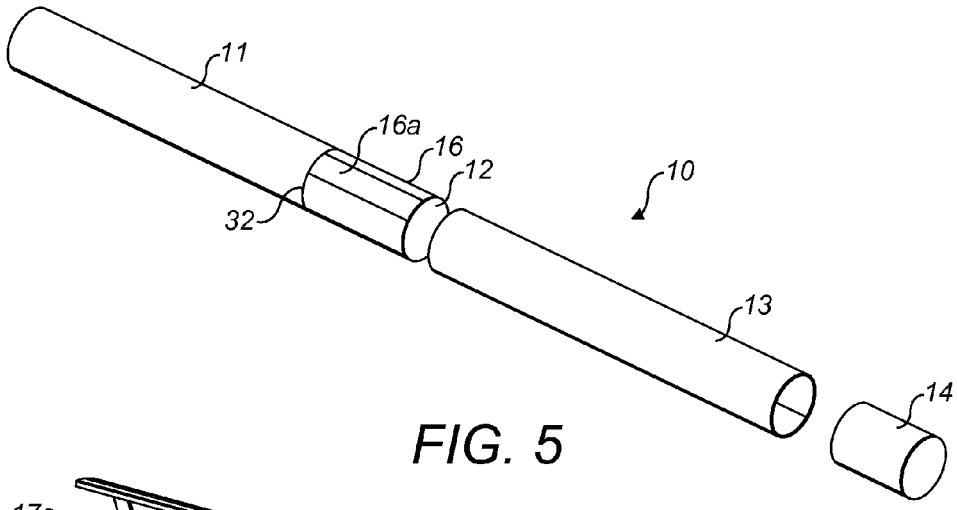
FIG. 5 is an exploded perspective view of the smoking article.

FIG. 5 shows an exploded view of smoking article 10, in which a tobacco rod 11 and first filter section 12 are joined by a covering layer in the form of a strip of sheet material, preferably tipping paper 16, as is conventionally known. The tipping paper 16 is preferably made of a relatively heavy weight paper. The tipping paper 16 has an overlapping section 16*a* which is affixed to an overlapped part of the tipping paper 16, for example with an adhesive. The tobacco rod 11, first filter section 12 and tipping paper 16 are formed as a conventional cigarette. The length of the tobacco rod 11 may be 48 mm, which is shorter than in a typical cigarette. The first and second filter sections are preferably harder than a typical cigarette filter. Preferably, the smoking article includes either a first filter or any other relatively hard substance at the end of the tobacco rod 11.

The sheet material 16 extends radially outwardly from the source of smokable material. The sheet material which connects the tobacco rod 11 and first filter section 12 defines the second engaging surface 32 of the restraining means. The second engaging surface 32 is the surface of the wrapped sheet material which extends radially outwardly from the source of smokable material, and faces in an axially forward direction.

Alternatively, the second engaging surface may be formed on a folded section of sheet material, wrapped around the tobacco unit. A fold is formed adjacent a rearward end of the sheet material, such that a folded section extends outwardly and forwardly. The second engaging surface is formed on a forward facing edge of the folded section.

The first filter or other hard substance adjacent to the tipping paper 16 assists in creating or maintaining the second engaging surface 32 onto which the sleeve 13 can abut to prevent the tobacco rod 11 from separating from the sleeve 13.

Figure 6:
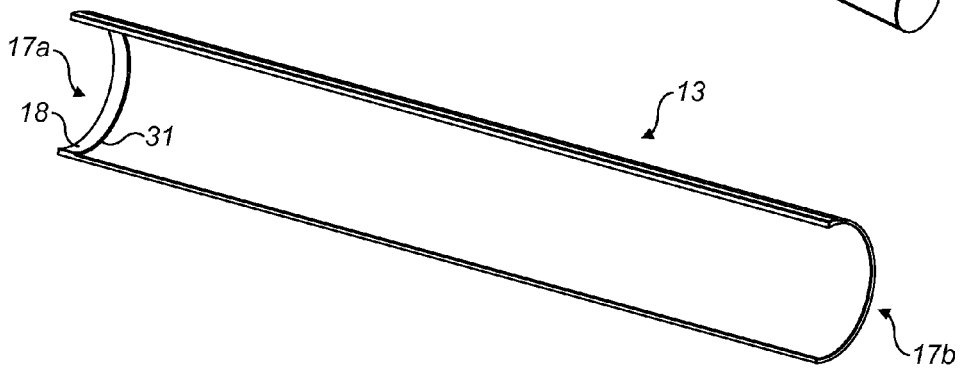
FIG. 6 is a cut-away perspective view of a part of the smoking article.

FIG. 6 shows a perspective sectional view of sleeve 13. The sleeve 13 has a forward end 17*a* which surrounds the tobacco rod 11 when assembled. The sleeve 13 has a rearward end 17*b*, for receiving the second filter 14, and forming a mouthpiece end of the smoking article.

The sleeve 13 is preferably formed from a sheet material, and in particular, a paper material. In particular, the sleeve 13 may be formed of a relatively heavy weight paper.

At the forward end 17*a* of the sleeve 13, a projecting section 18 extends radially inwardly. The projecting section 18 is formed by folding inwardly the sleeve material at the forward end 17*a* to form an overlap. In particular, the projecting section 18 is formed by a fold in the material of the sleeve 13, in a radially inward direction, such that the folded sheet material is adjacent to an interior surface of the sleeve 13. The projecting section is preferably folded by approximately 180 degrees.

The first engaging surface 31 of the restraining means is formed on the projecting section 18. The first engaging surface 31 is the surface extending radially inwardly from the cylindrical sleeve, and facing in an axially rearward direction. The first engaging surface 31 is within the cylindrical sleeve.

The smoking article of FIG. 4 has an analogous restraining means, preventing relative movement of the sleeve 23 and filter 24 beyond a maximum extent.

Preferably, the restraining means comprises engaging surfaces on or adjacent to the sleeve 23*a* and filter 24. The sleeve 23*a* defines a first engaging section formed on an inwardly folded section. The folded section is preferably folded by approximately 180 degrees. The filter 24 defines a second engaging surface which can abut the first engaging section and limit movement. The second engaging surface is formed adjacent the forward end of the filter 24, and may be formed by an outwardly folded over section of filter wrapping material. The folded section is preferably folded by approximately 180 degrees. Alternatively, the second engaging surface may be formed on or one or more layers of sheet material (e.g. tipping paper) wrapped around a part of the filter 24. The second engaging surface may be formed on a part of the sheet material containing and supporting the filter material, termed plugwrap.

One or more of the filter sections may be formed of a single segment of filter material or a plurality of segments. A filter section formed of a plurality of segments may comprise segments made of different materials or having different filtration properties. In particular, a filter section may comprise a standard segment of cellulose acetate tow and a further segment of filtration material including charcoal. Alternatively, the filter section may be a single segment incorporating charcoal.

One or more additives or flavourants may be present in only one of the first or second filter sections 12,14, or in both first and second filter sections. In particular, the second filter section 14 only may comprise charcoal, and the first filter section 12 may not comprise charcoal. Alternatively, the first filter section 12 only may comprise charcoal, and the second filter section 14 may not comprise charcoal. Alternatively, the sheet material surrounding the tobacco rod, first or second filters may comprise tobacco.

Figure 7:
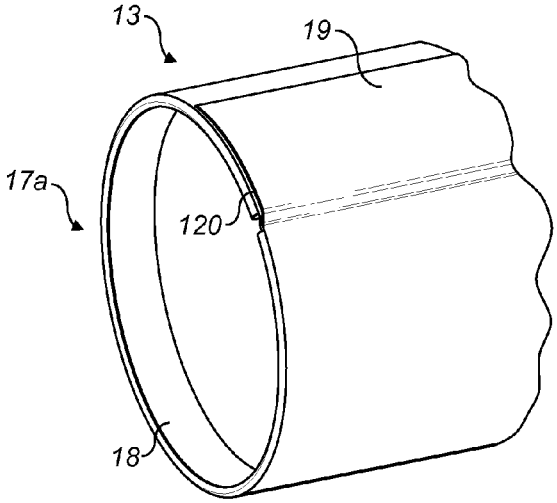
FIG. 7 is an enlarged perspective view of the part of FIG. 6.

FIG. 7 is an enlarged view of the forward end 17*a* of the sleeve 13. The projecting section 18 is shown in more detail. The projecting section 18 extends around substantially the whole circumference of the sleeve, providing a continuous second engaging surface around the circumference. The sleeve 13 is formed of a strip of material which is curled into a cylinder. The long sides of the sleeve 13 are brought together and overlapped to form an overlap section 19. The overlap section 19 of the sleeve 13 overlies and is affixed to the opposite side of the sheet material forming the sleeve. Preferably, the overlap section 19 is affixed with adhesive.

Figure 8:
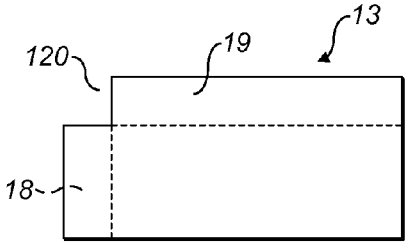
FIG. 8 is a plan view of a blank for forming the part of FIG. 6.

FIG. 8 shows a plan view of the sleeve 13, indicating the positions of the projecting section 18 defining the first engaging section and the overlap section 19. The overlap section 19 does not provide material for the projecting section 18 at the forward end 17*a* of the sleeve. A cut-out 120 is defined on the overlap section 19. The cut-out 20 has the same or slightly larger height than the overlap section 19 in a direction laterally across the sleeve blank. The cut-out 120 has substantially the same width as the material forming the projecting section 18, in a direction longitudinally along the sleeve blank. Thus, the projecting section 18 provides a uniform first engaging surface substantially around the whole circumference of the sleeve 13. The projecting section 18 has a substantially uniform radial extent around the circumference, since the cut-out 120 ensures the overlap section 19 does not contribute to the projecting section 18. The cut-out 120 thus prevents a doubling of material thickness on the projecting section 18.

Figure 9:
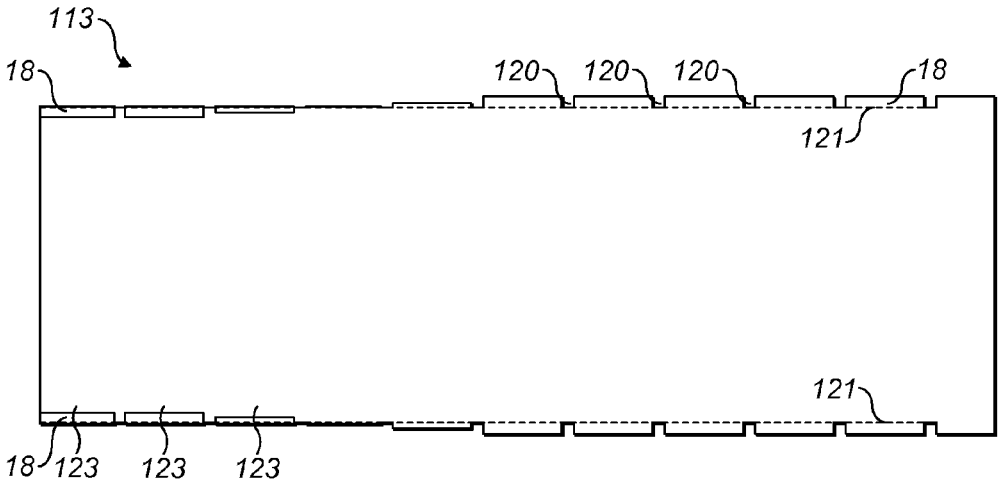
FIG. 9 is a plan view of a blank for forming a plurality of the parts of FIG. 6.

FIG. 9 shows a plan view of a blank of material 113 prepared to be formed into a plurality of sleeves 113. The material 113 will receive a plurality of lateral cuts (e.g. along line 128 and parallel lines) and later receive one longitudinal cut. The width of the blank 113 corresponds to a length of the sleeves. The material 113 has been prepared by forming cut-outs 120. The cut-outs 120 define individual projecting sections 18. Each sleeve 113 will have one projecting section 18 and one cut-out 120. The material 113 has been perforated along lines 121. The perforation lines 121 ensure a defined and controlled edge at the forward end 17*a* when the projecting sections 18 are folded over. The perforation lines 121 may be formed on-line or pre-perforated. The projecting sections 18 are shown in various states of folding, from fully folded at the left hand side as shown, to unfolded at the right hand side as shown. The projecting sections 18 may be folded over and not affixed (e.g. without adhesive) to the interior surface of the sleeve. Resilience of the sleeve material may urge the projecting sections 18 radially inwardly a small distance, improving the functioning of the projecting section 18 to engage with the tipping paper 16. Alternatively, the projecting sections 18 may be affixed to an inner surface of the sleeve 13 when overlapped, in particular, with adhesive.

Figure 10:
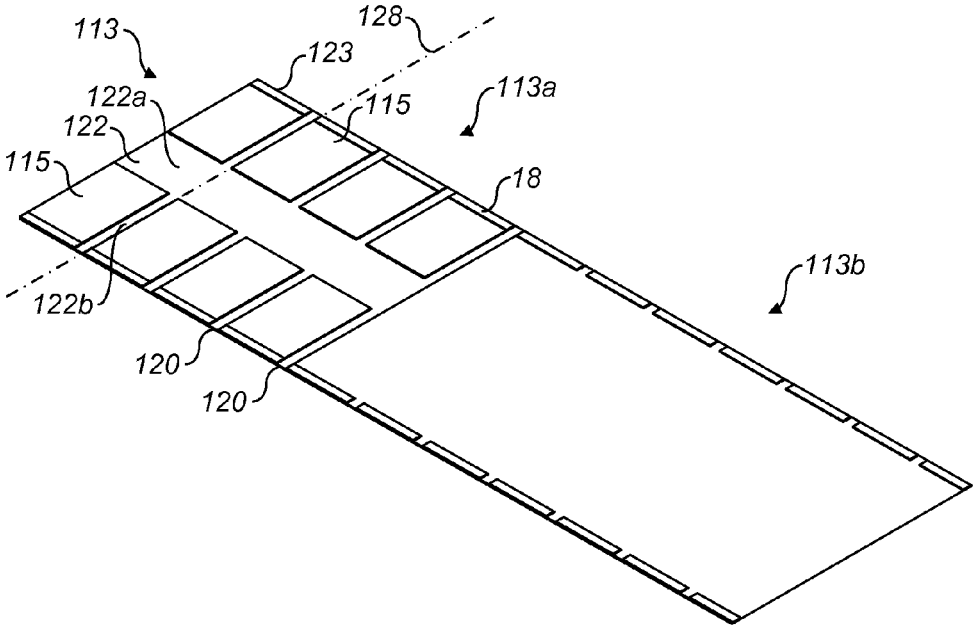
FIG. 10 is a plan view of the blank of FIG. 7 in a further stage of manufacture.

FIG. 10 shows a further stage in the preparation of the material 113. An adhesive 122 has been applied to a portion 113*a* of the material 113. A portion 113*b* has yet to receive the adhesive 122. The adhesive 122 is applied to a central, first, portion 122*a* along the length of the material 113. A further, second, portion of adhesive 122*b* is applied in transverse strips aligned with the cut-out 120, i.e. between the projecting sections 18. The first and second portions of adhesive may be applied concurrently or consecutively. The adhesive (glue) is applied with synchronized glue rollers. The cut position is registered to the glue profile (adhesive area). The cut-out position is also registered to the glue profile (adhesive area).

The material 113 is cut transversely along line 128 into a strip 123, the strip 123 including two projecting sections 118 (one on each side of the strip 123), and one adhesive section 122*b* extending over the whole lateral width of the material 113. The strip 123 is for forming two sleeves 13. The strip 123 is aligned with the tobacco rods 11, tipping papers 16, first and second filter sections 114. The central adhesive area 122*a* is aligned with the double second filter unit 114. The central adhesive portion 122*a* extends a distance in a central section of the strip 123 which is substantially the same or less than the length of the double second filter unit 114. Thus, central adhesive portion 122*a* adheres to the double second filter unit 114 only, and does not adhere to the tipping paper 16. Material patch 115 is formed as an area which is not provided with adhesive. The material patch 115 is aligned with the tipping paper 16 and a part of the length of the tobacco rod 11.

Figure 11:
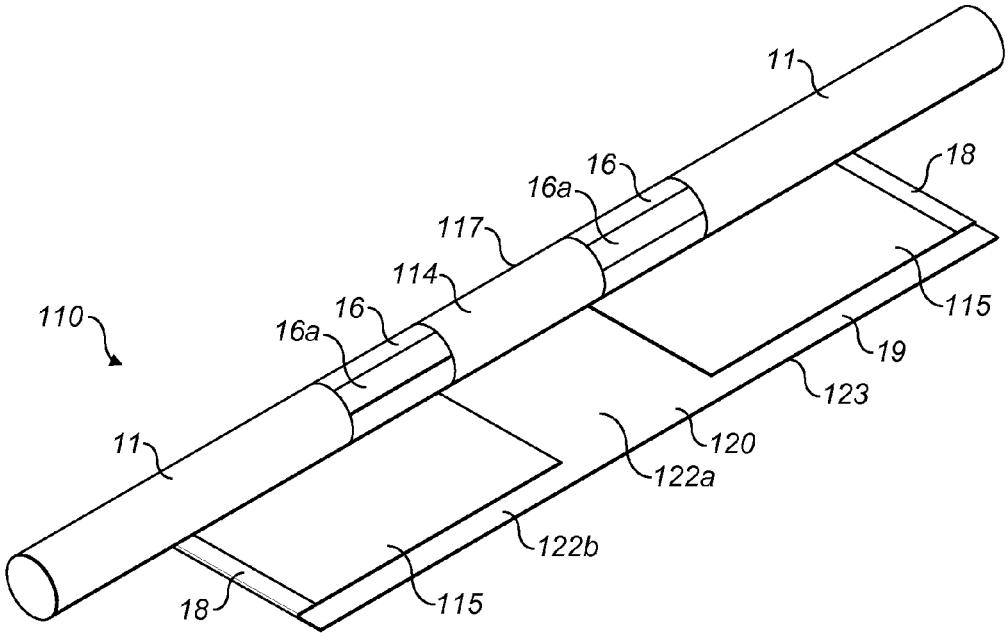
FIG. 11 is a perspective view of the smoking articles during manufacture.

FIG. 11 shows the formation of a double unit 110. The double unit 110 will be cut in half at a point 117 as a final stage in manufacture, to form two extendable smoking articles.

The double unit 110 comprises two tobacco rods 11, two sets of tipping paper 16 joining a first filter to each tobacco rod. The double unit 110 further comprises a double length second filter 114.

The strip 123 is wrapped around the tobacco rods 11, tipping papers 16, first and second filter sections 114. Adhesive area 122*b* adheres to an exterior surface of the other long side of the strip 123, forming the sleeve when the overlap section 19 is affixed.

The double unit 110 is then cut transversely in half at point 117 to form two smoking articles 10. The cutting action cuts through both the double-length filter 114 and the double-length sleeve 123.

The formed smoking articles 10 do not have an adhesive in contact with the tobacco rod or tipping paper 16, allowing axial movement of the tobacco rod 11 and first filter section relative to the second filter section 114. A maximum extension of the smoking article 10 is reached when the projecting section 18 abuts against tipping paper 16, and in particular, against tipping paper overlap section 16*a*. A minimum extension is obtained when the first and second filter sections are abutting.

The filter and smoking article diameters are accurately pre-determined to ensure the function of the smoking article. If the diameter of the first filter section at the end of the source of smokable material is too small, the sleeve blank material will be wrapped too tightly around the sliding source of smokable material, and the source of smokable material will therefore not slide easily in the sleeve. If the first filter section diameter is too large the sliding source of smokable material will have a very loose fit in the sleeve.

The first and/or second engaging surface may be angled relative to a plane perpendicular to the axis of the smoking article. The angled first and/or second engaging surfaces may be arranged such that relative rotation actuates relative longitudinal movement.

Figure 12:
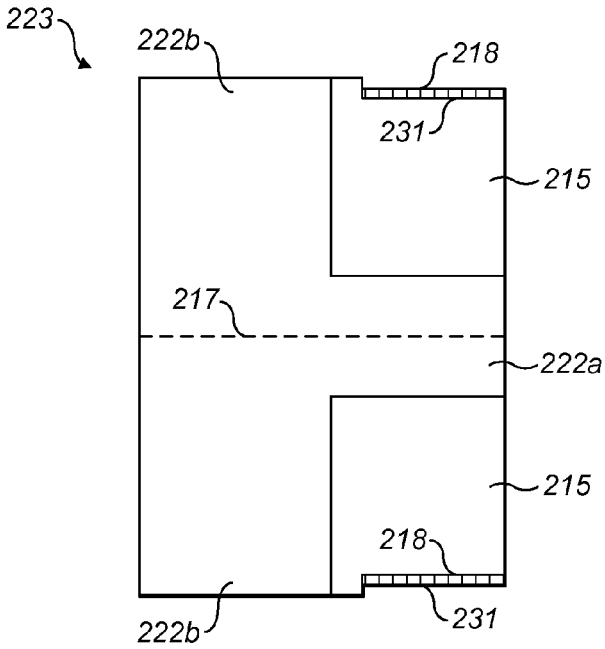
FIG. 12 is a plan view of a further embodiment of a blank for forming part of a smoking article.

FIG. 12 shows a plan view of a further embodiment of blank 223 for forming two sleeves, each slidable around a tobacco unit as described above. The blank 223 is formed analogously to blank 123 as described above in the manufacture of two smoking articles. The blank 223 is cut in half along line 217 to form the two sleeves.

The sleeve blank has a width which is approximately twice the circumference of the tobacco unit and/or second filter on which it is wrapped as a cylindrical tube, and preferably forms a sleeve having at least two complete layers. Preferably, the sleeve is dimensioned to be wrapped twice around the tobacco unit and form a cylinder with two layers, an inner layer and an outer layer Forming the sleeve with a plurality of layers allows a lower weight sheet material (preferably paper) to be used, compared to a sleeve formed from a single layer of sheet material. The lower weight paper improves the formation of a lap seam, in which an edge of the paper overlies and adheres to an opposite side of the blank, as described above. In addition, the lower weight paper of the blank can be curled more easily to form a cylinder.

An adhesive is applied to blank 223 over a first portion 222*a*, which extends on both sleeves. The first portion 222*a* of adhesive is configured to adhere to the second filter section at a mouth end of the smoking article. Alternatively, the first portion 222*a* of adhesive is configured to adhere to the tobacco unit.

An adhesive is applied to blank 223 over a second portion 222*b*, which extends on both sleeves. The second portion 222*b* of adhesive is configured to adhere to an underlying layer of blank, when the blank is formed into a sleeve. The second portion 222*b* has a width approximately corresponding to the circumference of the sleeve. The adhesive area 222*b* extends across substantially the whole area of the outer layer. The outer layer and inner layer of the sleeve are adhered across substantially their whole areas. Alternatively, the second portion 222*b* of adhesive may extend over only a part of the outer layer when formed into a sleeve.

The blank defines a material patch area 215, which is not provided with adhesive. The material patch area 215 will surround the tobacco unit when the smoking article is assembled. Alternatively, the material patch area 215 will surround the second filter when the smoking article is assembled. The absence of adhesive in area 215 ensures that the first part of the smoking article can slide freely relative to, and around, the second part. The area 215 has a width corresponding to, or slightly exceeding, the inner circumference of the formed sleeve.

The blank 223 defines a first engaging surface 231, forming part of the restraining means to limit relative longitudinal movement between the first and second parts of the smoking article. The first engaging surface 231 may be formed on a folded over projecting section 218. The projecting section 218 may extend over only part of the width of blank 223, preferably less than half of the width, such that the first engaging surface 231 extends around substantially the whole circumference of the inner layer, and does not extend on the outer layer. The folding over of section 218 reduces the height of the blank 223 corresponding to the inner layer. The outer layer therefore extends longitudinally beyond the inner layer, covering and preventing viewing of the end of the inner layer.

Alternatively, the first engaging surface 231 may be formed by embossing the inner layer. The embossed area, substantially corresponding to projecting section 218, has an increased thickness which functions as a stop. The first engaging surface 231 may be defined by the embossed section, and engagable with the second engaging surface to restrain the first and second parts of the smoking article.

Figure 13:
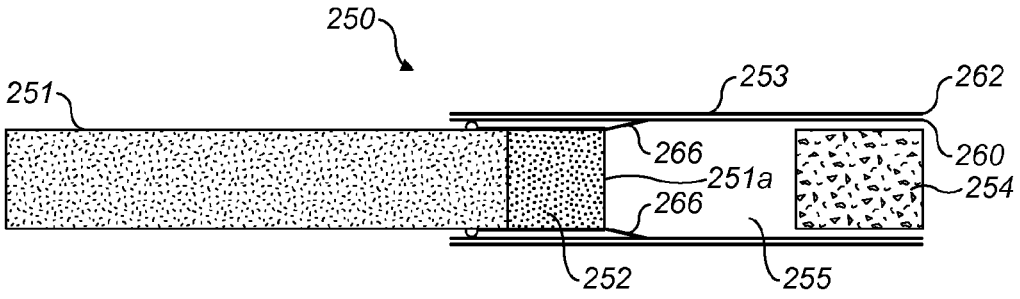
FIG. 13 is a cut-away side elevation view of the further embodiment of smoking article, in an extended state.
Figure 14:
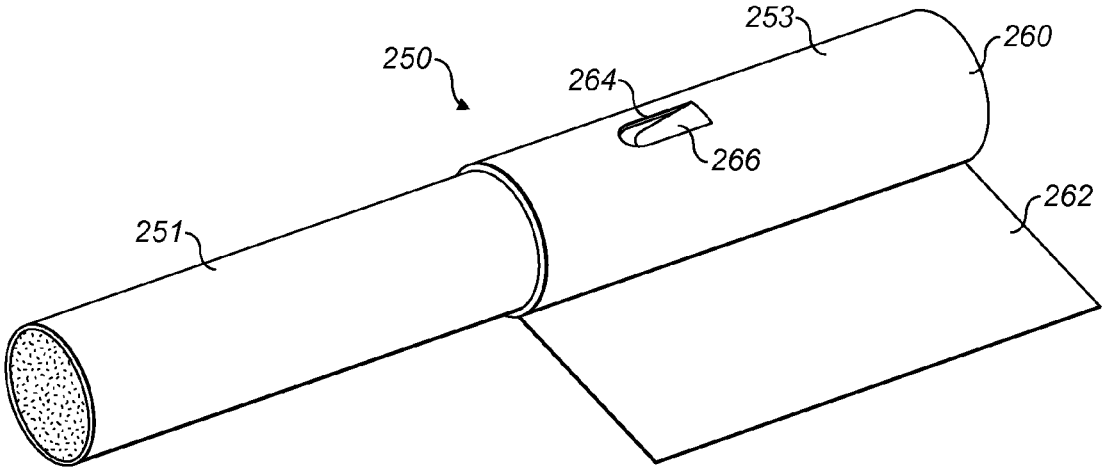
FIG. 14 is a perspective view of the smoking article of FIG. 13, in a partially formed state.

FIGS. 13 and 14 show a smoking article 250 including a sleeve 253 formed from the blank 223. The smoking article 250 has a source of smokable material 251 attached to a first filter 252. The source of smokable material 251 and first filter 252 are movable together, and may be referred to as a tobacco unit. The sleeve 253 is slidable longitudinally around the source of smokable material 251 and/or the first filter 252. A second filter is attached to the sleeve 253 at a mouth, or rearward, end. A chamber 255 is defined by the sleeve between the first and second filters 252,254. A length of the chamber 255 is variable as the sleeve 253 slides relative to the source of smokable material.

The sleeve 253 is formed from a plurality of layers of sheet material. Preferably, the sleeve 253 comprises two layers of sheet material, an inner layer 260 and an outer layer 262. Preferably, the sheet material is paper. As described with respect to FIG. 12, the outer layer 262 may be adhered to the inner layer 260 over a majority of the area of the layers 260,262. The inner and outer layers 260,262 may be formed from a single sheet of material wrapped twice around the filters, or may be formed from two separate sheets of material affixed together.

The smoking article 250 may comprise at least one non-return mechanism. The non-return mechanism is configured to allow extension of the smoking article, with the tobacco unit sliding longitudinally within the sleeve 253. Once a pre-determined extension has been reached, the non-return mechanism prevents the tobacco unit from being retracted back within the sleeve 253 beyond that pre-determined extension. The smoking article 250 can therefore be extended from a retracted state, and only partially retracted back to a predetermined extension. The predetermined extension may be substantially the same position as a maximum extension. In this case, the tobacco unit is locked in the maximum extension position.

The non-return mechanism comprises a tongue 266 extending radially inwardly from the inner layer 260. The tongue 266 is formed by a D-shaped (or U-shaped) cut 264 in the material of the inner layer 260. The tongue is a flap extending into the chamber 255, and connected to the inner layer 260. The D-shaped cut 264 is orientated such that the tongue extends substantially forwardly, and can pivot about a connection to the inner layer 260 at its rearward end. The tongue 266 can be resiliently urged into a plane of the inner layer 260, and springs back into the chamber 255 when no force is applied. The tongue 266 is preferably formed only by the inner layer 260, and not by the outer layer 262. The outer layer 262 covers the tongue 266, and is not affixed to the tongue.

In a retracted state, the tongue 266 overlies the tobacco unit and is maintained by the tobacco unit in a radially outward position substantially in the plane of the inner layer 260. The tongue 266 does not prevent the tobacco unit 261 sliding within the sleeve 253 to extend the smoking article. At the pre-determined extension, a rearward end 251*a* of the tobacco unit is positioned forwardly of the tongue 266. The tongue 266 resiliently springs radially inwardly into the chamber 255. As the tobacco unit 251 is urged rearwardly for retraction, a forward end of the tongue 266 engages with the rearward end 251*a* of the tobacco unit, preventing retraction beyond the pre-determined extension.

The smoking article may have one or more tongues 266, and two tongues 266 are shown in FIG. 13. The plurality of tongues 266 are spaced circumferentially around the sleeve.

The outer layer 262 is described as covering the inner layer. Alternatively, the sleeve may be formed from a single layer of sheet material. When the tobacco unit is not extended up to the pre-determined extension, the tongue 266 is substantially in the plane of the layer of sheet material forming the sleeve, and substantially prevents ingress of air into the chamber.

When the tobacco unit is extended beyond the pre-determined extension, an aperture is formed by the D-shaped cut and the radially inward position of the tongue. The aperture allows ventilation to the chamber.

The non-return mechanism may also be used in the embodiment in which the second part is a mouth end filter movable within the sleeve 253. One or more tongues 266 are formed by a D-shaped cut 264 formed in the opposite direction, such that the tongue 266 extends substantially rearwardly. The further features of the non-return mechanism described above are also apply, and the retraction of the second filter is limited.

The D-shaped cut 264 is described as made on the inner layer 260 only. Alternatively, the D-shaped cut 264 may be made on both the inner layer 260 and outer layer 262.

Figure 15:
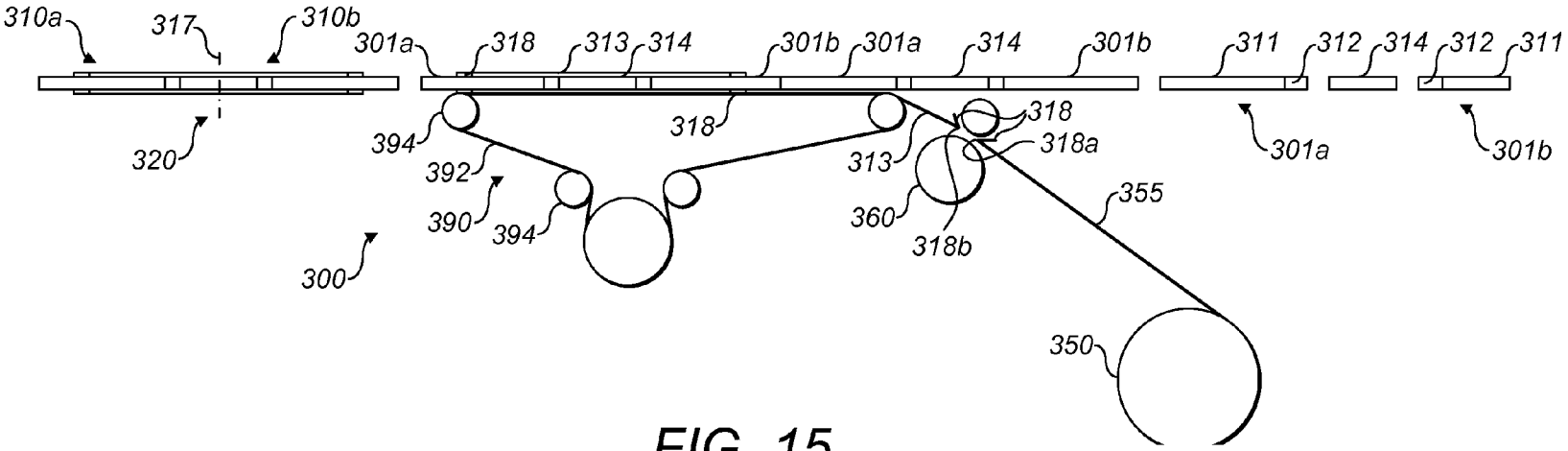
FIG. 15 is a schematic side elevation of a first embodiment of manufacturing apparatus.

FIG. 15 shows schematically a manufacturing apparatus 300 for manufacturing an extendable smoking article substantially as described above, with reference to FIGS. 1 to 3 and 5 to 8. A method of manufacturing an extendable smoking article according to the present invention using the manufacturing apparatus is also described.

The manufacturing apparatus 300 comprises a wrapping station configured to form the sleeve of an extendable smoking article substantially as described above. The apparatus 300 comprises a garniture for wrapping the sheet material of the sleeve around a connected tobacco rod and a first filter section, and also around a separate second filter section. The apparatus 300 may be a modification of a known apparatus configured to wrap tipping paper around a tobacco rod and filter, in order to connect the tobacco rod and filter.

The apparatus 300 comprises a source of sheet material 355 to be formed into a plurality of the sleeves. The sheet material 355 is preferably paper, and more preferably, a heavy weight (i.e. area density) paper, e.g. of approximately 100 $g/m^2$ or more. The paper may be tipping paper conventionally used to connect a tobacco rod and filter. The source of sheet material is preferably a bobbin 350 on which a continuous length of elongate sheet material 355 is wound for storage. The sheet material 355 may be air impermeable, or may be air permeable or have ventilation apertures pre-applied or applied during the manufacturing method. The sheet material 355 is preferably paper, without any adhesive pre-applied. Alternatively, the sheet material 355 may have adhesive pre-applied. The sheet material may be supplied on adhesive labels wound onto a backing paper. The bobbin 350 is rotatable to dispense the sheet material to a preparation assembly 360.

The preparation assembly 360 is configured to receive a continuous length of the sheet material for forming the sleeves. The preparation assembly 360 comprises a cutting assembly configured to cut the continuous length of sheet material into discrete sections 313 of a pre-determined length. The length of the section 313 is equal to twice the length of a sleeve on a smoking article according to the present invention, since each section 313 is a blank for two sleeves. The cutting assembly may comprise a knife, for example, a cross-cut knife. Alternatively, the cutting assembly may comprise one or more rollers or any other means configured to cut sheet material substantially perpendicularly to the length of the elongate sheet material. The longitudinal axis (length) of the sheet material and sections 313 corresponds to a longitudinal axis of the sleeves. The cutting assembly generates a forward edge and a rearward edge for each separate section of sheet material, relative to the direction of travel of the sheet material from the bobbin 350 to the preparation assembly 360.

The assembly 360 further comprises an engaging surface generation means configured to generate a first engaging surface on the sleeve. The engaging surface generation means preferably comprises a folding assembly configured to fold the discrete sections 313 of sheet material. The folding assembly is configured to form projecting sections 318, identical to the projecting sections 18 described above. The folding assembly forms a fold for each of the two sleeves which the blank 313 will become, namely: a first fold 318*a* adjacent and parallel to the forward edge of each section of sheet material 355, and also a second fold 318*b* adjacent and parallel to the rearward edge of each section of sheet material 355. The folds 318*a*,318*b* fold the two projection sections 318 to the same side of the section 313 of sheet material. The folds 318*a*,318*b* are approximately 180 degree folds, such that the projecting sections 318 are substantially adjacent or overlying an adjacent part of the section 313. The first fold 318*a* generates a folded section extending rearwardly, and having a first engaging surface facing rearwardly. The second fold 318*b* generates a folded section extending forwardly, and having a first engaging surface facing forwardly.

The folding assembly may comprise a first set of rollers comprising one or more rollers and configured to partially create the first fold 318*a*. The partial first fold 318*a* is a fold through less than the 180 degrees of the final fold. The first roller preferably has a gear profile configured to create a partial fold. A second set of rollers comprising one or more rollers is configured to complete the first fold 318*a*, such that the sheet of material is folded through substantially 180 degrees. The second rollers may comprise a pair of opposed rollers which receives the sheet material with the partially folded projecting section 318 extending out from the plane of the sheet material. The second rollers compress the section 313 to urge the projecting section 318 into the plane of the sheet material. The second fold 318*b* is formed in the same manner, by the same first and second rollers or by separate first and second rollers. Alternatively, the folds may be formed by a single set of rollers. Alternatively, the folds may be formed by a different mechanism, which does not use, or does not only use, rollers. A first mechanism may partially form the or each fold, and a separate second mechanism may complete the or each fold. The first and second mechanism, preferably comprising rollers, are spaced apart to separately and sequentially form the partial fold and then complete the fold.

Alternatively, the engaging surface generation means may comprise an embossing means configured to emboss the sections of sheet material 313. The embossing means may be any known system for embossing first and second areas of the paper of the sheet material, in substantially the same area as the folded sections described above. The first engaging surfaces are formed on the edge of the embossed section, at the step formed to the non-embossed parts of the sections of sheet material 313. Alternatively, the sheet material may be embossed in addition to being folded. Alternatively, the apparatus 300 may not comprise a surface generation means. The sheet material stored on the bobbin 350 may be provided with pre-applied retaining bands. The retaining bands are preferably strips of paper extending laterally and affixed to the sheet material 355. The retaining bands define the first engaging surfaces. The retaining bands are registered to the correct position on the base smoking article. The first engaging surfaces are formed on the edge of the retaining bands, at the step formed to the part of sheet material without a retaining band.

The assembly 360 may comprise a means for creating cut-outs 120 in the sections 313, as described with respect to FIGS. 7 and 8. A cut-out 120 is formed for each folded section. The cut-outs 120 may be formed by any suitable cutting means, e.g. a cutting die. The means for creating a cut-out may be at any stage in manufacturing process prior to the sections 313 being formed into cylinders. Alternatively, the sheet material may have pre-formed cut-outs, with the cut-outs formed in the sheet material on the bobbin.

The sections 313, with a pair of formed first engaging surfaces, are fed into a garniture assembly 390. The garniture assembly 390 comprises a garniture belt 392 supported by a plurality of rollers 394. The garniture belt 392 is an endless tape substantially as known in the art. Each section 313 preferably contacts the garniture belt, and is urged to travel with the garniture belt, before that section 313 is released by the assembly 360. Each section 313 may be released when the cutting assembly cuts the section 313 from the following sheet material, or when the folding assembly completes formation of the folds. The garniture belt 392 is moving at a higher linear speed than the feed rate through the preparation assembly, and so the sections 313 of sheet material are pulled and accelerated onto the garniture belt 392 when released.

The garniture belt 392 is configured to sequentially receive sections 313 of sheet material, and curl each section 313 around a longitudinal axis to form a cylindrical tube or sleeve. The sections 313 are wrapped by the garniture belt around the further components of the extendable smoking article, namely a tobacco unit comprising a tobacco rod 311 and first filter section 312, and a second filter section 314.

The feed rate for the preparation assembly 360, i.e. the cutting assembly and folding assembly, from the bobbin 350 is slower than the linear speed of the garniture belt 392. The sections of sheet material 313 are fed into the preparation assembly 360 at a slower speed (i.e. length per unit time) than the linear speed of the garniture belt 392. Thus, consecutive sections of sheet material 313 are spaced apart from each other on the garniture belt 392. The sections of sheet material 313 extend over only a part of the length of the smoking articles, and so the spacing of the sections of sheet material 313 determines the length of the second part of the smoking articles which are not covered by the sheet material 313.

The garniture assembly 390 receives the components for combining into the smoking articles from one or more hopper systems. The hopper systems may be any conventional hopper systems configured to supply the components of base smoking articles and double-length second filter sections. The base smoking articles are similar to a conventional smoking article as described above, i.e. a tobacco rod connected to a first filter section with a wrap of sheet material (tipping paper). The base smoking article is supplied fully formed to the garniture assembly 390. The hopper system may be based on a double-action plug-tube combiner (DAPTC) or a multi-filter maker e.g. a Mulfi system.

The apparatus comprises one or more adhesive applicators to apply adhesive to the section 313 and/or the other components of the smoking article. The adhesive is configured to hold a section 313 in a cylindrical tube to form a sleeve. The adhesive is also configured to secure the second filter section 314 within the sleeve. Preferably, a first adhesive applicator is configured to apply adhesive to the sections of sheet material 313 prior to the garniture assembly, the adhesive is preferably located to secure the second filter section 314 within the sleeve. Alternatively, the adhesive is located to hold the section 313 in a cylindrical tube.

A second adhesive applicator is configured to apply adhesive to the sections of sheet material 313 on the garniture assembly (on the garniture belt), the adhesive preferably located for holding the section 313 in a cylindrical tube. Alternatively, the adhesive is located to secure the second filter section 314 within the sleeve. Alternatively, the first and second adhesive applicators may be located in the garniture assembly.

The first adhesive applicator is configured to apply adhesive to affix the second filter section 314 to the section 313 of sheet material. The second filter section 314 is permanently fixed to a mouthpiece end of the sleeve of the finished smoking article. The adhesive used is preferably polyvinyl acetate (PVA) glue, a hot melt adhesive or may be any suitable adhesive. The second filter section 314 is located on the section 313 of sheet material prior to its rolling into the cylindrical sleeve. The adhesive is pulsed to coincide with the second filter section. The adhesive to secure the second filter section 314 is applied to the section 313 and/or second filter section 314, prior to the section 313 of sheet material being formed into the cylindrical sleeve.

The second adhesive applicator is configured to apply adhesive to a longitudinal seam of the section 313 to maintain the cylindrical shape of the formed sleeve. The adhesive is preferably polyvinyl acetate (PVA) glue, hot melt adhesive or may be any suitable adhesive. The adhesive is applied in pulses to coincide with the sleeve. The adhesive is applied such that the cylindrical sleeve and second filter can slide longitudinally around the base smoking article.

The garniture assembly 390 is configured to wrap and secure the blank sections 313 around the base smoking articles and double-length second filter to form a dual extendable smoking article 320 according to the present invention.

The apparatus further comprises a processing assembly for receiving the dual smoking articles 320 from the garniture assembly 390. The processing assembly may comprise a catcher drum (not shown) to receive the dual smoking articles. The processing assembly further comprises a splitting mechanism configured to receive two smoking article formed together from the garniture assembly. The splitting mechanism is configured to cut the two smoking articles formed together into individual smoking articles 310*a*,310*b* along a line 317, through the sleeve and double-length second filter section. The splitting means preferably comprises a cutting assembly, preferably a knife head. The cutting assembly may cut the dual smoking articles on the catcher drum. The splitting means may be similar to a conventional splitting means configured to cut in half a conventional dual smoking article, which does not have a sleeve or second filter section.

The processing assembly is further configured to rotate one or both of the split individual smoking articles such that all the smoking articles have the same orientation on exiting the apparatus 300.

Figure 16:
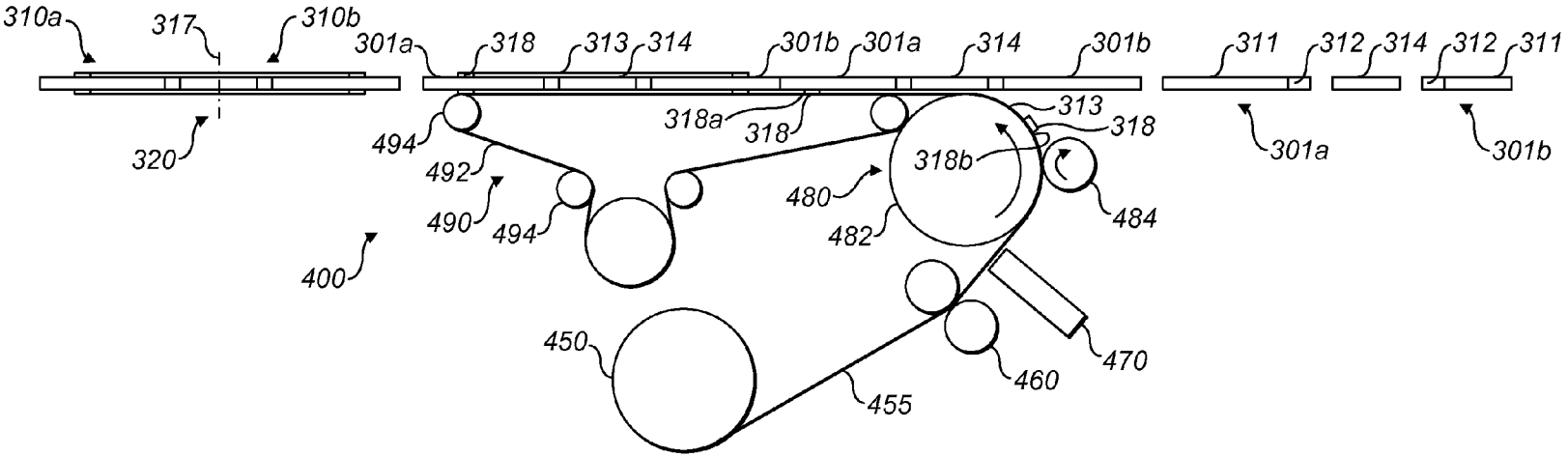
FIG. 16 is a schematic side elevation of a second embodiment of manufacturing apparatus.

FIG. 16 shows schematically an alternative manufacturing apparatus 400 for manufacturing an extendable smoking article substantially as described above, with reference to FIGS. 1 to 3 and 5 to 8. A method of manufacturing an extendable smoking article according to the present invention using the manufacturing apparatus is also described.

The manufacturing apparatus 400 comprises a wrapping station configured to form the sleeve of an extendable smoking article substantially as described above. The apparatus 400 comprises a garniture for wrapping the sheet material of the sleeve around a tobacco rod and a filter. The apparatus 400 may be a modification of a known apparatus configured to wrap tipping paper around a tobacco rod and filter, in order to connect the tobacco rod and filter.

The apparatus 400 comprises a source of sheet material 455 to be formed into a plurality of the sleeves. The sheet material 455 is preferably paper, and more preferably, a heavy weight paper, e.g. of approximately 100 g/m$^2$. The paper may be tipping paper conventionally used to connect a tobacco rod and filter. The source of sheet material is preferably a bobbin 450 on which a continuous length of sheet material 455 is wound for storage. The sheet material 455 may be air impermeable, or may be air permeable or have ventilation apertures pre-applied or applied during the manufacturing method. The sheet material 455 is the same as sheet material 355, and may be any type of sheet material as described for sheet material 355. The bobbin 450 is rotatable to dispense the sheet material to feed rollers 460.

The feed rollers 460 pull the sheet material from the bobbin 460. The feed rollers comprise a pair of opposed rollers engaging the sheet material between them. The feed rollers 460 may function as an engaging surface generation means configured to partly form or form a first engaging surface on the sleeve. The feed rollers 460 are configured to crimp or emboss the sheet material to provide the first engaging surface. The feed rollers 460 transfer the continuous length of sheet material 455 to a first adhesive applicator 470.

The first adhesive applicator 470 is configured to apply an adhesive in pulses to the sheet material 455, for affixing a second filter section 314 to the sheet material, substantially as described above. The pulses are timed to align the part of the sheet material with the expected position of the second filter section 341. The adhesive used is a hot melt adhesive or a polyvinyl acetate (PVA) glue.

After the first adhesive applicator 470, the sheet material passes into a preparation assembly 480, which is configured to receive a continuous length of the sheet material for forming the sleeves. The preparation assembly 480 comprises a rotatable vacuum drum 482. The vacuum drum 482 is configured to receive the continuous sheet material, and generate a vacuum to attach the sheet material to an exterior surface of the vacuum drum. The vacuum drum rotates to transfer the sheet material to a garniture assembly 490.

The preparation assembly 480 comprises a cutting assembly configured to cut the continuous length of sheet material into discrete sections 313 of a pre-determined length, as described above. The cutting assembly may comprise a roller 484 having a knife or edge for crush cutting. The roller 484 is configured to co-operate with the vacuum drum, which functions as an anvil. The sheet material passes between the vacuum drum 482 and roller 484, which rotate in opposite directions, and cut the sheet material into discrete sections 313. The sheet material is cut substantially perpendicularly to the length of the elongate sheet material. The longitudinal axis (length) of the sheet material and sections 313 correspond to a longitudinal axis of the sleeves. The cutting assembly generates a forward edge and a rearward edge for each separate section of sheet material, relative to the direction of travel of the sheet material.

The preparation assembly 480 may alternatively comprise an engaging surface generation means configured to generate a first engaging surface on the sleeve. The engaging surface generation means preferably comprises a folding assembly configured to fold the discrete sections 313 of sheet material. The folding assembly is configured to form projecting sections 318, identical to the projecting sections 18 described above. The folding assembly forms a first fold 318*a* adjacent and parallel to the forward edge of each section of sheet material 455, and also a second fold 318*b* adjacent and parallel to the rearward edge of each section of sheet material 355. The folds 318*a*,318*b* fold the two projection sections 318 to the same side of the section 313 of sheet material. The folds are approximately 180 degree folds, such that the projecting sections 318 are substantially adjacent or overlying an adjacent part of the section 313. The first fold 318*a* generates a folded section extending rearwardly, and having a first engaging surface facing rearwardly. The second fold 318*b* generates a folded section extending forwardly, and having a first engaging surface facing forwardly.

A roller or rollers (not shown) may be configured to form the first fold 318*a*, such that the sheet of material is folded through substantially 180 degrees. The folds are preferably formed by a single set of rollers. Alternatively, the preparation assembly may comprise a first set of rollers which partially fold a projecting section 318 extending out from the plane of the sheet material, and a separate second set of rollers which complete the fold. The second set of roller(s) compresses the section 313 to urge the projecting section 318 into the plane of the sheet material, optionally by co-operating with the vacuum drum 482. The second fold 318*b* is formed in the same manner, by the same rollers or by separate rollers.

Alternatively, the apparatus 300 may not comprise a surface generation means. The sheet material stored on the bobbin 450 may be provided with pre-applied retaining bands, as described above with respect to the apparatus 300.

The assembly 480 may comprise a means for creating cut-outs 120 in the sections 313, as described with respect to FIG. 8. A cut-out 120 is formed for each folded section, as described above with respect to the apparatus 300.

The sections 313, with a pair of formed first engaging surfaces, are fed into the garniture assembly 490. The garniture assembly 490 comprises a garniture belt 492 supported by a plurality of rollers 494. The garniture belt 492 is an endless tape substantially as known in the art. Each section 313 preferably contacts the garniture belt, and is urged to travel with the garniture belt, before that section 313 is released by the assembly 360. Each section 313 may be released onto the garniture belt when the vacuum drum 482 releases that section. The garniture belt 392 and vacuum drum 482 preferably move the sheet material at substantially the same linear speed, which is a higher speed than the feed rate through the first adhesive applicator 470 and feed rollers 460 from the bobbin 450. The sections 313 of sheet material are pulled and accelerated by the vacuum drum when released by the cutting assembly.

Thus, consecutive sections of sheet material 313 are spaced apart from each other on the garniture belt 492. The sections of sheet material 313 extend over only a part of the length of the smoking articles, and so the spacing of the sections of sheet material 313 determines the length of the smoking articles which are not covered by the sheet material 313.

The garniture belt 392 is configured to sequentially receive sections 313 of sheet material, and curl each section 313 around a longitudinal axis to form a cylindrical tube or sleeve. The sections 313 are wrapped by the garniture belt around the further components of the extendable smoking article, namely a tobacco unit comprising a tobacco rod 311 and first filter section 312, and a second filter section 314.

The garniture assembly 490 receives the components for combining into the smoking articles from one or more hopper systems. The hopper systems may be any conventional hopper systems configured to supply the components of base smoking articles and double-length second filter sections. The base smoking articles are similar to a conventional smoking article as described above, i.e. a tobacco rod connected to a first filter section with a wrap of sheet material (tipping paper). The base smoking article is supplied fully formed to the garniture assembly 490. The hopper system may be based on a double-action plug-tube combiner (DAPTC) or a multi-filter maker e.g. a Mulfi system.

The garniture assembly further comprises one or more second adhesive applicators to apply adhesive to the section 313 and/or the other components of the smoking article. The adhesive is configured to hold a section 313 in a cylindrical tube to form a sleeve.

The second adhesive applicator is configured to apply adhesive to a longitudinal seam of the section 313 to maintain the cylindrical shape of the formed sleeve. The adhesive is preferably polyvinyl acetate (PVA) glue, hot melt glue or may be any suitable adhesive. The adhesive is applied such that the cylindrical sleeve and second filter can slide longitudinally around the base smoking article.

The garniture assembly 490 is configured to wrap and secure the blank sections 313 around the base smoking articles and double-length second filter to form a dual extendable smoking article according to the present invention.

The apparatus further comprises a processing assembly (not shown) for receiving the dual smoking articles 320 from the garniture assembly 390. The processing assembly may comprise a catcher drum (not shown) to receive the dual smoking articles. The processing assembly further comprises a splitting mechanism configured to receive two smoking article formed together from the garniture assembly. The splitting mechanism is configured to cut the two smoking article formed together into individual smoking articles 310*a*, 310*b* along a line 317, through the sleeve and double-length second filter section. The splitting means preferably comprises a cutting assembly, preferably a knife head. The cutting assembly may cut the dual smoking articles on the catcher drum. The splitting means may be similar to a conventional splitting means configured to cut in half a conventional dual smoking article, which does not have a sleeve or second filter section.

The processing assembly is further configured to rotate one or both of the split individual smoking articles such that all the smoking articles have the same orientation on exiting the apparatus 300.

The apparatus 300,400 may be modified to manufacture a smoking article 20 as described in FIG. 4. The smoking article 20 may be formed as a dual smoking article, sharing a common double-length filter. The sleeve 23 is wrapped on the garniture assembly 390,490 around a cylinder of tobacco. The sleeve entering the garniture assembly 390,490 has only one folded end. Alternatively, the smoking article 20 may be formed as a dual smoking article, sharing a common double-length tobacco rod. The sleeve 23 is wrapped on the garniture assembly 390,490 around two co-axial cylinders of tobacco. The sleeve entering the garniture assembly 390,490 has two folded ends, as described above, and a second filter section is located at each end of the double length tobacco rod. The double length tobacco rod is then cut in half to form two smoking articles.

The method of manufacturing the smoking articles is now described with reference to FIGS. 15 and 16. The apparatus 300 receives the components for forming the smoking articles from the hopper system (not shown). Alternatively, the hopper system may be part of the apparatus 300. The different components are received in a pre-determined sequence and orientation.

The sequence of delivery on the garniture belt 392,492 for forming two smoking articles is now described. The garniture belt 392,492 firstly receives a base smoking article 301*a* comprising a tobacco rod 311 and a co-axial first filter section 312, which are preferably already connected by tipping paper as known in the art. The first filter section 312 is at a rearward end of the smoking article 301*a* in the direction of travel into the garniture assembly. Next, a double-length second filter section 314 is received. As described above, the second filter section 314 is preferably a conventional filtration material, e.g. cellulose acetate tow, wrapped in a paper plugwrap. Next, a second base smoking article 301*b* is received, which comprises a tobacco rod 311 and a co-axial first filter section 312, which are preferably connected by tipping paper as known in the art. The first filter section 312 is at a forward end of the smoking article 301*b* in the direction of travel into the garniture assembly. A further sequence of three separate components abuts against the earlier sequence, such that the components are continuously located on the garniture belt. The sequence of three separate components is repeated to continually manufacture smoking articles.

The components are manipulated such that the first and second filter sections are adjacent each other. In particular, the first base smoking article 301*a*, double-length second filter section 314 and second base smoking article 301*b* are controlled to abut each other in co-axial alignment in that order.

A folded section of sheet material 313 is provided from the preparation assembly 360 or drum 480, as described above. The section of sheet material 313 may be in contact with the garniture belt 392,492 prior to being cut by the cutting assembly, and so may be pulled into the garniture assembly 390,490 immediately on being cut and separated from the following sheet material 355.

The garniture assembly 390,490 applies a section of sheet material 313 to the adjacent components. A forward end of the section of sheet material 313 is aligned longitudinally with a pre-determined first alignment point on the tobacco rod of the first base smoking article 301*a*. The first alignment point is spaced from the forward end and rearward end of the tobacco rod 311, and may be at between 20% and 80%, and preferably between 20% and 40% along the length of the tobacco rod from a forward end.

The applied section of sheet material 313 extends over part of the first base smoking article 301*a*, the whole of the second filter section 314, and part of the second base smoking article 301*b*. The rearward end of the section of sheet material 313 is aligned longitudinally with a pre-determined second alignment point on the tobacco rod of the second smoking article 301*b*. The second alignment point is the same distance from the rearward end of the second base smoking article 301*b* as the first alignment point is the same distance from the forward end of the first base smoking article 301*a*. The section of sheet material 313 extends over the same longitudinal extent of the tobacco rods of the first and second base smoking articles from the first filter sections 312, such that each individual smoking article according to the invention is identical.

The garniture assembly 390 wraps the section of sheet material 313 around the first base smoking article 301*a*, double-length second filter section 314, and second base smoking article 301*b*, and a cylindrical sleeve is formed by the garniture belt 392. The garniture assembly applies an adhesive such that the double-length second filter section 314 is adhered to the sleeve adjacent both a forward and rearward end of the second filter section 314, and the section of sheet material 313 is fixed as a cylindrical sleeve.

A double-length smoking article exits the garniture assembly, and is cut into two equal parts through the double-length second filter on a knife head. The individual smoking articles are orientated in the same way, and are then transferred to be packaged.

The cutting assembly and folding assembly have been described as part of the same assembly. Alternatively, the cutting assembly and folding assembly may be in separate assemblies.

Figure 17:
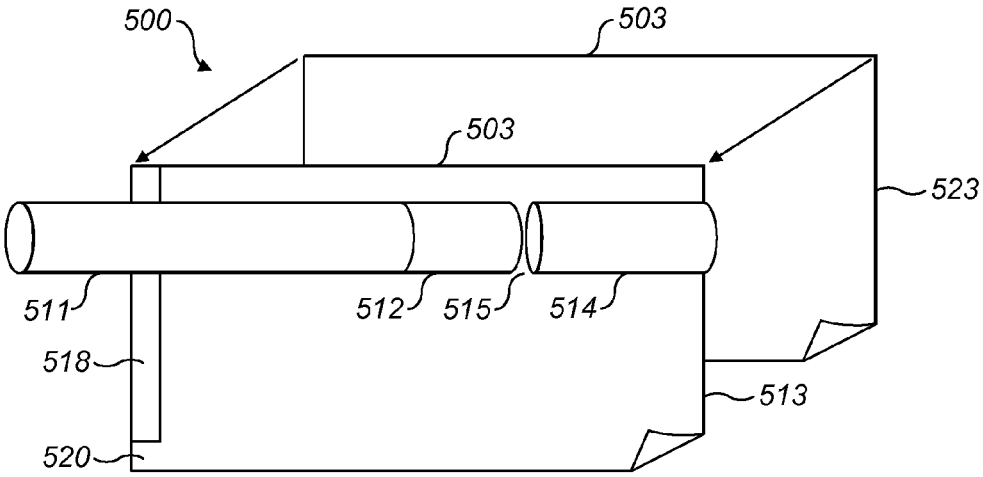
FIG. 17 is a perspective view of a further embodiment of smoking article during manufacture.
Figure 18A:
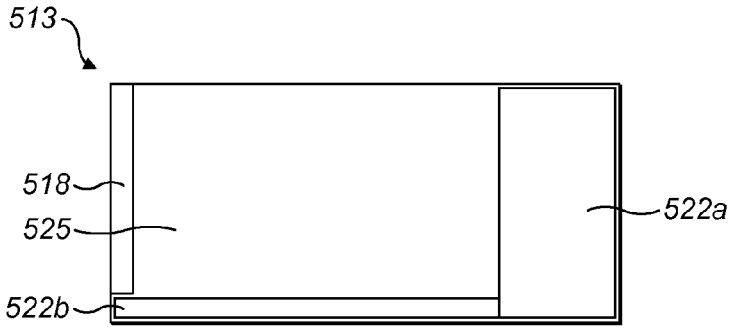
FIGS. 18*a* and 18*b* are plan views of a blank for manufacture of parts of the smoking article of FIG. 17.
Figure 18B:
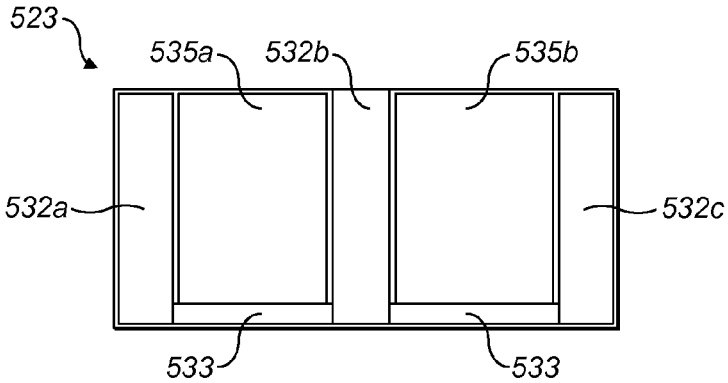

FIGS. 17,18*a* and 18*b* show a smoking article 500 formed substantially as described with respect to FIGS. 1 to 3 and 5 to 14. The smoking article 500 is an extendable smoking article comprising a sleeve 503 formed from a first, inner, layer of sheet material 513 and a second, outer, layer of sheet material 523. The smoking article 500 has a source of smokable material 511 attached to a first filter 512. The source of smokable material 511 and first filter 512 are preferably connected by a sheet material, e.g. tipping paper. The source of smokable material 511 and first filter 512 are movable together, and may be referred to as a tobacco unit. The sleeve is slidable longitudinally around the source of smokable material 511 and/or the first filter 512. A second filter 514 is attached to the sleeve at a mouth, or rearward, end. A chamber 515 is defined by the sleeve between the first and second filters 512,514. A length of the chamber 515 is variable as the sleeve slides relative to the source of smokable material.

The smoking article 500 is preferably formed as a single smoking article. Alternatively, smoking articles may be formed in pairs as described with respect to FIGS. 5 to 14, and cut into individual smoking articles.

The sleeve 503 is formed from a plurality of layers of sheet material. Preferably, the sleeve 503 comprises two layers of sheet material, an inner layer 513 and an outer layer 523. Preferably, the sheet material is paper. The inner layer 513 may have the same construction, and be formed with the same method, as the sleeve 13 described and shown in FIGS. 5 to 12.

FIG. 17 shows the inner layer 513 of the sleeve comprises a projecting section 518 extending radially inwardly on the formed sleeve. The projecting section 518 is formed by folding the sleeve material at the forward end to form an overlap. The projecting section is preferably folded by approximately 180 degrees. The projecting section 518 defines a first engaging surface of the restraining means, as described above.

The projecting section 518 extends around substantially the whole circumference of the inner layer of the sleeve. The longitudinal sides of the sleeve 513 are brought together and overlapped to form an inner cylinder. An overlap section of the inner sleeve 513 overlies and is affixed to the opposite side of the sheet material forming the inner sleeve 513. Preferably, the overlap section is affixed to the opposite side with adhesive.

The inner layer 513 defines a cut-out 520 on the overlap section, substantially as described above. The cut-out 520 provides a uniform first engaging surface substantially around the whole circumference of the sleeve 13, and provides a uniform thickness for the overlap section. The projecting section 518 has a substantially uniform radial extent around the circumference, since the cut-out 520 ensures the overlap section does not contribute to the projecting section 518.

The source of smokable material 511 and first filter 512 are connected together by a sheet material wrapped around and adhered to the source of smokable material 511 and first filter 512. The sheet material extends radially outwardly from the source of smokable material. The sheet material which connects the tobacco rod 511 and first filter section 512 defines the second engaging surface 32 of the restraining means. The second engaging surface is the surface of the wrapped sheet material which extends radially outwardly from the source of smokable material, and faces in an axially forward direction.

The inner layer 513 and outer layer 523 of the sleeve are formed as separate, unconnected, sections of sheet material. The sheet material for the inner layer 513 is preferably a different material to the sheet material of the outer layer 523. Preferably, the outer layer 523 is a more dense paper than the inner layer 513. The outer layer 523 may also have a higher thickness than the inner layer 513. The inner layer 513 may have an area density (grammage/weight) of 30 to 50 g/m$^2$, and preferably approximately 40 g/m$^2$. The outer layer 523 may have an area density of 50 to 70 g/m$^2$, and preferably approximately 60 g/m$^2$.

FIG. 18*a* shows a plan view of a blank of the inner layer 513, prior to rolling around a longitudinal axis into a cylinder. The inner layer 513 is preferably formed from a highly porous paper, for example, plug wrap. An adhesive is applied to a first portion 522*a* adjacent a lateral edge of the inner layer 513 opposite to the projecting section 518. The first portion of adhesive 522*a* is configured to surround and adhere to the second filter 514. A further, second, portion of adhesive 522*b* is applied adjacent a longitudinal edge of the inner layer 513. The second portion of adhesive 522*b* is configured to be on the overlap section, and adhere to an opposite edge of the inner layer 513 when the blank is rolled into a cylinder. The second portion of adhesive 522*b* forms a lap seam. The first and second portions of adhesive may be applied concurrently or consecutively. The adhesive (glue) is applied with synchronized glue rollers. A material patch 525 is formed as an area which is not provided with adhesive. The material patch 525 is aligned with the first filter 512 and a part of the length of the tobacco rod. The patch 525 is permeable to air due to the properties of the sheet material, and allows ventilation into the chamber and/or first filter. The inner layer 513 is manufactured substantially as described with respect to FIGS. 5 to 12.

FIG. 18*b* shows a plan view of a blank of the outer layer 523, prior to rolling around a longitudinal axis into a cylinder. The outer layer 523 is preferably formed from an air impermeable paper, for example, a tipping paper. An adhesive is applied to one or more areas of the outer layer 523 in order to affix the outer layer 523 to the inner layer 513. The adhesive is applied in a plurality of longitudinally spaced sections, the longitudinally spaced sections extend laterally and preferably over substantially the whole width of the outer layer 523. Preferably, the adhesive is located on a first section 532*a* adjacent a first lateral edge of the outer layer 523, and a second section 532*c* adjacent a second lateral edge opposite to the first lateral edge. A third section 532*b* extends laterally between the first section 532*a* and the second section 532*c*.

A further portion of adhesive 533 is applied adjacent a longitudinal edge of the outer layer 523. The further portion of adhesive 533 is configured to be on the overlap section, and adhere to an opposite edge of the outer layer 523 when the blank is rolled into a cylinder. The further portion of adhesive 533 forms a lap seam. The portions of adhesive may be applied concurrently or consecutively. The adhesive (glue) is applied with synchronized glue rollers. One or more material patches 535*a*, 535*b* are formed as an area which is not provided with adhesive. Preferably, the outer sleeve comprises two separate patches 535*a*, 535*b* which are not covered in adhesive.

The material patches 535*a*, 535*b* are treated to be permeable to air. Preferably, apertures are formed in the sheet material with electrostatic perforation to provide a pre-determined porosity. Alternatively, the sheet material may be porous due to apertures formed by laser or any other means, or by selection of a porous sheet material. The sheet material may be treated to be porous over its entire surface, with the impermeable adhesive blocking air flow except for the areas of the patches 535*a*, 535*b*. Alternatively, only a part of the area of the outer layer is treated to be porous, preferably, the whole areas of the patches 535*a*, 535*b*, e.g. by electrostatic perforation of only the areas of the patches. Alternatively, only a part of the areas of the patches not covered with adhesive are treated to be air permeable. The adhesive pattern does not cover the entire surface area of the outer layer 523, and so allows for ventilation through the sleeve 503. Preferably, ventilation is provided through the outer layer and inner layer over the whole area of the sleeve which is not covered in adhesive.

The outer layer 523 does not provide any retaining edge to limit extension of the smoking article. The outer layer 523 provides structural rigidity to the sleeve 503, in combination with the inner layer. The inner layer 513 alone may provide a retaining edge to limit extension of the smoking article, and/or a non-return mechanism as described above.

The inner layer 513 has been described as formed from a porous plug wrap paper, and the outer layer 523 from a conventional tipping paper. Alternatively, the inner layer 513 can be formed from a standard weight (grammage) tipping paper, preferably having the same thickness as the tipping on the smoking article connecting the tobacco rod 511 and first filter 512. The outer layer 523 is formed of a paper which is more dense and/or thicker than the inner layer 513. The inner layer 513 and outer layer may be treated to be air permeable, by forming ventilation apertures, e.g. using a laser. The inner layer 513 and outer layer 523 are air permeable over coincident areas, to allow air flow into the sleeve 503. The inner layer 513 may have an area density of 30 to 50 g/m$^2$, and preferably approximately 40 g/m$^2$. The outer layer 523 may have an area density of 50 to 70 g/m$^2$, and preferably approximately 60 g/m$^2$.

A method of manufacturing the smoking article 500 is now described. Analogously to the methods described above, the inner layer 513 is coated with adhesive and wrapped around the tobacco unit 511,512 and second filter 514. The inner layer 513 is formed into a cylinder, adhered to the second filter, and secured as a cylinder by the lap seam. After the inner layer 513 has been formed into a cylinder, the outer layer 523 is applied to the inner layer. The outer layer 523 is coated with adhesive and wrapped around the inner layer 513, secured to the inner layer by the sections of adhesive and secured as a cylinder by the lap seam. The consecutive, separate, processes of forming the cylinder of the inner layer and the cylinder of the outer layer allows a thicker, heavier weight, paper to be easily used for the outer layer. The inner layer provides a guide and support for the outer layer during rolling into a cylinder. References to paper weight should be interpreted as indicating the weight of the paper per unit area.

The portions of adhesive 522*b*,533 for forming a lap seam have been shown extending along a longitudinal edge of the inner and outer layers up to a separate section of adhesive. Formation of the lap seam preferably requires adhesive to extend over the whole length of the layer, and so the portions of adhesive 522*b*,533 can be considered as extending the whole length of the layer, and the further portions of adhesive 522*a*,532*a*,532*b*,532*c* extending over the remaining areas described. The portions of adhesive 532*a*,532*b*,532*c* on the outer layer are only examples of possible adhesive patterns, and any pattern which affixes the outer layer to the inner layer and provides at least one area free of adhesive to allow ventilation is within the scope of the invention.

Adhesive is described as applied to the outer layer. Alternatively, adhesive may be applied to an exterior surface of the inner layer, in order to affix the outer layer.

The smoking article 500 has been described as extendable. Alternatively, the sleeve may rotate relative to the source of smokable material without longitudinal movement, with the smoking article (first and second engaging surfaces as described) configured to stop relative longitudinal movement between the first and second parts.

The smoking article 500 has been described as having two layers formed from two separate sheets. Alternatively, the two layers may be formed from a single continuous sheet, wrapped two or more times around the source of smokable material and filters.

The second engaging surface of the restraining means has been described in some embodiments as formed by a sheet of material connecting the source of smokable material to a filter. Alternatively, the second engaging surface may be formed in any embodiment by any radially extending surface. In particular, the second engaging surface may be formed by a sheet of material wrapped one or more times around the source of smokable material or around the first filter, and not connecting the source of smokable material to a filter. The second engaging surface of any embodiment may be formed on a portion of sheet material which is folded radially outwardly, and folded forwardly to overlie the tobacco unit or filter. A blank for the second engaging surface may include a cut-out as described above.

The first and/or second engaging surface of any embodiment may be formed by an embossed surface. In particular, embossing may be used instead of folding sheet material in any embodiment, including when the first or second part is formed from a single layer only of sheet material.

A yield of the smoking article may depend on ventilation apertures, or perforations, in the sleeve, filter plugwraps and/or in the tobacco unit. The ventilation apertures may be covered by the sleeve, preventing ingress of air through the covered ventilation apertures.

At least some ventilation apertures on the tobacco unit may always be covered by the sleeve. Such ventilation apertures are always covered during normal use, i.e. at any extension of the smoking article between a maximum and minimum extension, or for any relative movement between the sleeve and tobacco unit. Such ventilation apertures have no effect on ventilation when the sleeve is properly attached to the tobacco unit. In particular, such ventilation apertures provide no ventilation when the first part is attached to the second part and for any relative longitudinal or rotational movement between the first and second parts as limited by the first and second engaging surfaces.

If the sleeve is removed from the tobacco unit, which is not generally how the smoking article is configured for use, such ventilation apertures will be uncovered. These ventilation apertures may provide a very high level of ventilation, for example equal to or greater than 60% ventilation, equal to or greater than 70% ventilation, equal to or greater than 80% ventilation or equal to or greater than 90% ventilation in examples of the invention, which significantly lowers the yield of the smoking article without the sleeve. These ventilation apertures therefore control yield of the tobacco unit when the sleeve has been improperly removed.

At least some ventilation apertures may be included on the tobacco unit which are not covered by the sleeve, in a retracted state. The ventilation apertures ensure that at least a minimum amount of ventilation is provided, or that the ventilation is between a pre-determined minimum and maximum ventilation, depending on extension. Thus, the yield is known to be in a range between a pre-determined minimum and maximum yield. Any of the embodiments described may have one or more ventilation apertures in the first part and/or second which are selectively covered by the other of the first and second parts, according to the relative longitudinal position between the first and second parts, and/or by the relative rotational position between the first and second parts. The ventilation apertures allow ventilating air flow into the chamber and/or into the first filter. The ventilation of the smoking article is determined by the area of apertures which are not covered, which is determined by selection of the relative longitudinal position and/or the relative rotational position between the first and second parts.

Any of the features of any embodiment may be combined with any of the features of any other embodiment. In particular, any of the embodiments of smoking article may or may not have a filter section adjoining the cylinder of tobacco, or may not have a filter section at the mouthpiece end of the sleeve.

The smoking article has been described as extendable. Alternatively, the smoking article of any embodiment may have a fixed overall length. The sleeve or filter may be rotated without allowing or actuating a change in the length of the smoking article. The restraining means may allow rotation of the sleeve, and not allow relative longitudinal movement between the sleeve and a source of smokable material. The restraining means may be arranged such that the chamber is of a fixed length, which may be zero. The smoking article is configured to maintain the first and second parts in a single longitudinal relative position or formation. The first and second engaging surfaces of the restraining means are configured to substantially prevent extension of the smoking article. The first and second engaging surfaces abut when the first filter section is abutting the second filter section. The first and second engaging surfaces stop extension or longitudinal movement in a first longitudinal direction, and the abutting first and second filter sections stop longitudinal movement in the opposite direction, to allow rotation and stop longitudinal movement. The restraining means may allow relative rotation between two adjacent filter sections, and optionally, the relative rotation may affect one or more of the filtration attributes, ventilation or flavourants of the smoking article.

The sleeve has been described as having a filter at a rearward end. Alternatively, a filter may not be affixed within the sleeve, and the sleeve may comprise only a cylindrical tube. Alternatively, a filter may not be affixed to a rearward end of the tobacco rod.

The smoking articles have been described as manufactured in pairs, and then cut into individual smoking articles. Alternatively, the smoking articles may be manufactured as individual smoking articles. The apparatus 300,400 may be configured to manufacture each smoking article separately, by cutting blanks of a length corresponding to one sleeve, and forming one first engaging surface in the blank.

The invention claimed is:

1. A smoking article comprising:

a first part configured to be moveable relative to a second part of the smoking article, the first part having a first engaging surface, the second part having a second engaging surface, the second engaging surface engagable with the first engaging surface to limit relative longitudinal movement between the first and second parts, wherein the first part comprises a sleeve and a filter attached to a mouth end of the sleeve; and the sleeve comprises an inner layer in the form of an inner cylindrical tube and an outer layer in the form of an outer cylindrical tube, and the inner cylindrical tube of the sleeve and the outer cylindrical tube of the sleeve have a forward end surrounding the second part and a rearward end receiving the filter, wherein the first engaging surface is within the inner cylindrical tube.

2. The smoking article as claimed in claim 1 wherein at least one of the first engaging surface and the second engaging surface is formed on a folded over portion of sheet material.

3. The smoking article as claimed in claim 1 or 2 wherein the first part comprises a sleeve formed from sheet material, and wherein the first engaging surface is formed on a folded over portion of said sheet material.

4. The smoking article as claimed in claim 1, wherein the second part comprises a source of smokeable material, or, the second part is a filter.

5. The smoking article as claimed in claim 4 wherein the second engaging surface is formed on one or more layers of sheet material connecting the source of smokable material to a first filter.

6. The smoking article as claimed in claim 1, wherein at least one of the first and the second part is formed from a blank of sheet material having an overlapping area which overlaps and is affixed to an opposite side of the sheet material to form a cylindrical tube, and wherein the blank has a cut-out aligned with the overlapping area such that the overlapping area does not contribute material to the first or second engaging surface.

7. The smoking article as claimed in claim 1, wherein the second engaging surface is formed on a portion of sheet material folded outwardly and forwardly to overlie an exterior surface of the second part.

8. The smoking article as claimed in claim 1, wherein the smoking article is configured to maintain the first and second parts at a single relative longitudinal position.

9. The smoking article as claimed in claim 8, wherein the first and second engaging surfaces are configured to stop longitudinal movement in a first longitudinal direction, and/or a filter section of the first part abuts a filter section of the second part to stop longitudinal movement in a second direction.

10. The smoking article as claimed in claim 1, wherein the sleeve is formed by a plurality of layers of sheet material.

11. The smoking article as claimed in claim 10 wherein the first engaging surface is formed only on an innermost layer of said plurality of layers of sheet material.

12. The smoking article as claimed in claim 10 wherein the sleeve comprises an inner layer and an outer layer of sheet material, and wherein the inner layer of sheet material and outer layer of sheet material are separate sheets.

13. The smoking article as claimed in claim 12 wherein the outer layer is formed of a sheet material having a higher area density than the inner layer.

14. The smoking article as claimed in claim 12, wherein the inner layer comprises an air permeable sheet material and the outer layer comprises an air impermeable sheet material treated over at least part of its area to be air permeable, or, the inner layer comprises an air impermeable sheet material treated over at least part of its area to be air permeable, and the outer layer comprises an air impermeable sheet material treated to be air permeable over an area at least partly coincident with the air permeable area of the inner layer.

15. The smoking article as claimed in claim 12, wherein the outer layer is affixed to the inner layer by an adhesive, and wherein the adhesive extends over only a part of the area of the outer layer.

16. The smoking article as claimed in claim 1, wherein the smoking article is an extendable smoking article and the first part is slidable longitudinally relative to the second part.

17. The smoking article as claimed in claim 1, wherein the first and second engaging surfaces are configured to interact such that relative rotational movement between the first and second parts provides relative longitudinal movement between the first and second parts.

18. The smoking article as claimed in claim 1, wherein a filter is coupled to the first part.

19. The smoking article as claimed in claim 16 wherein a chamber is formed by the first part, the chamber having a variable length.

20. The smoking article as claimed in claim 1, wherein the first part comprises a sleeve, wherein the second part comprises a source of smokable material, and wherein the second part comprises a plurality of ventilation apertures covered by the sleeve when the first part is attached to the second part and for any relative longitudinal or rotational movement between the first and second parts as limited by the first and second engaging surfaces.

21. The smoking article as claimed in claim 20 wherein the ventilation apertures provide a ventilation level no less than 60% to the second part when not attached to the first part.

22. The smoking article as claimed in claim 16 further comprising a non-return means configured to inhibit retraction of the smoking article.

23. The smoking article as claimed in claim 22 wherein the non-return means comprises a tongue on the first part, the tongue configured to engage with an end of the second part.

24. The smoking article as claimed in claim 23 wherein the tongue is formed by a cut in a sheet material forming the first part.

25. The smoking article as claimed in claim 10, wherein the tongue is formed only by an innermost layer of said plurality of layers of sheet material.

26. A method of manufacturing a smoking article comprising a first part and a second part, the method comprising:

providing the first part of the smoking article having a first engaging surface;

providing the second part of the smoking article having a second engaging surface;

wherein the first engaging surface is configured to engage with the second engaging surface to limit relative longitudinal movement between the first and second parts, forming a first part comprising a sleeve with an inner layer and an outer layer and a filter attached to a mouth end of the sleeve, wherein the sleeve comprises an inner layer in the form of an inner cylindrical tube and an outer layer in the form of an outer cylindrical tube, and the inner cylindrical tube of the sleeve and the outer cylindrical tube of the sleeve have a forward end surrounding the second part and a rearward end receiving the filter, and the first engaging surface is within the inner cylindrical tube.

27. The method as claimed in claim 26, further comprising:

providing a blank of sheet material for forming the first part or the second part, and folding over a portion of the blank to form the first or second engaging surface.

28. The method as claimed in claim 26 or 27 wherein the first part comprises a sleeve, and further comprising forming the sleeve from a blank of sheet material.

29. The method as claimed in claim 26, wherein the second part comprises one of a source of smokable material and a filter.

30. The method as claimed in claim 29, further comprising wrapping a layer of sheet material around the source of smokable material and a first filter, to secure the source of smokable material and a first filter together, wherein the wrapped layer of sheet material forms the second engaging surface.

31. The method as claimed in claim 28, further comprising wrapping the blank for forming the sleeve around the second part to form the sleeve.

32. The method as claimed in claim 28, further comprising forming at least one of the first and second parts by overlapping and affixing an overlapping area of the blank to an opposite side of the blank to form a cylindrical tube.

33. The method as claimed in claim 32, further comprising forming a cut-out in the blank aligned with the overlapping area such that the overlapping area does not contribute material to the first or second engaging surface.

34. The method as claimed in claim 26, further comprising connecting the filter to the first part.

35. The method as claimed in claim 26, further comprising providing a blank of sheet material for forming one of a first part and a second part, wherein the providing a blank of sheet material comprises:

providing sheet material for forming a plurality of blanks;

applying adhesive to the sheet material over a first area corresponding to overlapping areas arranged to overlap an opposite side of the sleeve to form a cylindrical tube;

cutting the sheet of material into strips for forming two of said first part or second part; and cutting a wrapped strip to provide two of said first part or second part.

36. The method as claimed in claim 35 further comprising forming a plurality of cut-outs in the sheet material for forming a plurality of blanks, the cut-outs arranged such that in each of said first part or second part a said cut-out is aligned with a said overlapping area such that said overlapping area does not contribute material to the first or second engaging surface.

37. The method as claimed in claim 35, further comprising applying adhesive to the sheet material over a second area to adhere the first part or second part to the filter;

providing a double filter for forming two filter sections;

wrapping a said strip around said double filter; and cutting the wrapped strip and the double filter to provide two of said first parts or second parts with a filter.

38. The method as claimed in claim 35, wherein a said strip is for forming the first part, and further comprising wrapping a said strip around:

two aligned sources of smokable material, each having a connected first filter; and a double filter for forming two second filter sections, aligned with the sources of smokable material;

wherein the method further comprises:

cutting the wrapped strip and the double filter to provide two smoking articles.

39. The method as claimed in claim 28, further comprising forming the sleeve with a plurality of layers of sheet material.

40. The method as claimed in claim 39, wherein the sleeve comprises an inner layer of sheet material and an outer layer of sheet material formed of separate sheets, and forming the sleeve comprises forming an inner cylindrical tube with the inner layer of sheet material, and then forming an outer cylindrical tube with the outer layer of sheet material around the inner cylindrical tube.

41. The method as claimed in claim 40 wherein the outer layer is formed of a higher density of sheet material than the inner layer.

42. The method as claimed in claim 40, wherein the inner layer comprises an air permeable sheet material, and the outer layer comprises an air impermeable sheet material, wherein the method further comprises treating the outer layer over at least part of its area to be air permeable, or, wherein the inner layer and the outer layer comprise an air impermeable sheet material, wherein the method further comprises treating the inner layer and outer layer to be air permeable over at least a coincident area.

43. The method as claimed in claim 40, further comprising affixing the outer layer to the inner later by an adhesive applied over only a part of the area of the outer layer.

44. The method as claimed in claim 26, wherein the smoking article is an extendable smoking article and the first part is slidable longitudinally relative to the second part, the method further comprising forming a non-return means configured to limit retraction of the smoking article.

45. The method as claimed in claim 28 further comprising:

providing an elongate sheet material for forming a plurality of sleeves;

cutting the elongate sheet material to form a plurality of discrete blanks, each blank for forming a first sleeve and a second sleeve, wherein the cuts in the elongate sheet material define a forward end and a rearward end of each blank;

providing a first engaging surface in the blank; and wrapping a said blank around a unit of the second part of the smoking article to form a substantially cylindrical sleeve.

46. The method as claimed in claim 45 further comprising:

providing a further first engaging surface in the blank; and cutting the sleeve to provide two smoking articles.

47. The method as claimed in claim 46, wherein wrapping a said blank further comprises:

wrapping the blank around a double-length second filter section, and/or wrapping the blank around the two units of the second part comprises wrapping the blank around two units each comprising a source of smokable material connected to a first filter section.

48. The method as claimed in claim 45, wherein wrapping a said blank comprises:

inserting the blank into a garniture assembly comprising a garniture belt;

inserting the second part of the smoking article into the garniture assembly; and wrapping the blank around the second part of the smoking article using the garniture belt.

49. The method as claimed in claim 48 wherein the sheet material for forming a blank is engaged with the garniture belt prior to cutting the blank from the following sheet material.

50. The method as claimed in claim 48 wherein a vacuum drum transfers the blank onto the garniture belt.

51. The method as claimed in claim 50 wherein the blank is cut from the following sheet material when carried by the vacuum drum.

52. The method as claimed in claim 45, wherein providing a first engaging surface on the blank comprises forming a first fold adjacent an end of each blank, and optionally, providing a further first engaging surface comprises forming a second fold adjacent the other end of the blank.

53. The method as claimed in claim 45, wherein providing the first engaging surface on the blank comprises one of embossing the blank, crimping the blank, and providing sheet material having pre-applied retaining bands.

54. The method as claimed in claim 27, wherein each fold is formed by a first mechanism which partially forms the fold, and wherein a second mechanism completes the formation of the fold, wherein the first mechanism comprises one or more rollers, and the second mechanism comprises one or more rollers.

55. The method as claimed in claim 53 wherein providing the first engaging surface on the blank comprises crimping the blank, and wherein a set of rollers draws the sheet material from a bobbin and crimps the sheet material to at least partially form the first engaging surface.

56. The method as claimed in claim 48, further comprising applying adhesive to the blank to secure the blank as a cylindrical sleeve, when the blank is carried on the garniture belt.

57. The method as claimed in claim 48, further comprising applying adhesive to the sheet material for forming the blank to secure the second filter section to the blank, prior to the blank being transferred to the garniture belt.

58. The method as claimed in claim 48 wherein one or more rollers engage the sheet material prior to cutting the sheet material into discrete blanks, wherein the one or more rollers rotate at a linear speed which is slower than a linear speed of the garniture belt.

59. An apparatus configured to manufacture smoking articles comprising:

a cutting assembly configured to cut an elongate sheet material into discrete blanks for forming sleeves;

an engaging surface generation means configured to generate a first engaging surface on a sleeve; and a wrapping mechanism configured to wrap a blank of sheet material around at least a part of a tobacco unit, such that the blank forms a sleeve moveable relative to the at least a part of a tobacco unit, wherein the wrapping mechanism is configured to form the sleeve with an inner layer and an outer layer, with a filter attached to the sleeve, and to arrange the inner layer in the form of an inner cylindrical tube and an outer layer in the form of an outer cylindrical tube, wherein the inner cylindrical tube of the sleeve and the outer cylindrical tube of the sleeve have a forward end surrounding the at least a part of a tobacco unit and a rearward end receiving the filter, and wherein the first engaging surface is within the inner cylindrical tube.

60. The apparatus as claimed in claim 59 wherein the engaging surface generation means comprises a folding assembly configured to fold over a portion of the blank to form the first engaging surface.

61. The apparatus as claimed in claim 60 wherein the folding assembly is further configured to form a first fold adjacent the forward end of each blank, and a second fold adjacent the rearward end of each blank, the apparatus further comprising a splitting assembly configured to cut the sleeve to provide two smoking articles.

62. The apparatus as claimed in claim 60 or 61 wherein the folding assembly comprises a first mechanism configured to partially form each fold, and a second mechanism configured to complete the formation of each fold, wherein the first mechanism comprises one or more rollers and the second mechanism comprises one or more rollers.

63. The apparatus as claimed in claim 59, further comprising a vacuum drum configured to transfer the discrete blanks for forming sleeves onto the wrapping mechanism.

64. The apparatus as claimed in claim 63, wherein the cutting assembly is further configured to cut the blanks from the following sheet material when the blank is carried by the vacuum drum.

65. The apparatus as claimed in claim 59, further comprising at least one adhesive applicator configured to apply adhesive to the blank to secure the blank as a cylindrical sleeve when on the wrapping mechanism.

66. The apparatus as claimed in claim 59, further comprising at least one adhesive applicator configured to apply adhesive to the sheet material for forming the blank to secure a second filter section to the blank prior to the blank being transferred to the wrapping mechanism.

67. The apparatus as claimed in claim 59, wherein the wrapping mechanism is a garniture assembly comprising a garniture belt.

68. An apparatus configured to produce smoking articles or parts of smoking articles according to the method as claimed in claim 26.

* * * * *

UNITED STATES PATENT AND TRADEMARK OFFICE

CERTIFICATE OF CORRECTION

PATENT NO. : 8,636,012 B2
APPLICATION NO. : 13/637980
DATED : January 28, 2014
INVENTOR(S) : Gerhard Le Roux et al.

It is certified that error appears in the above-identified patent and that said Letters Patent is hereby corrected as shown below:

In the Claims

Column 25, line 2, "later" should be changed to --layer--.

Signed and Sealed this
Twentieth Day of May, 2014

Michelle K. Lee

Michelle K. Lee
*Deputy Director of the United States Patent and Trademark Office*